US008801169B2

(12) United States Patent
Nakayama

(10) Patent No.: US 8,801,169 B2
(45) Date of Patent: Aug. 12, 2014

(54) NAIL PRINT APPARATUS INCLUDING BLOWING UNIT

(71) Applicant: Casio Computer Co., Ltd., Tokyo (JP)

(72) Inventor: Kenji Nakayama, Iruma (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/789,457

(22) Filed: Mar. 7, 2013

(65) Prior Publication Data

US 2013/0235137 A1 Sep. 12, 2013

(30) Foreign Application Priority Data

Mar. 12, 2012 (JP) ..... 2012-054669

(51) Int. Cl.
*B41J 2/01* (2006.01)
*A45D 29/18* (2006.01)
*B41J 11/00* (2006.01)

(52) U.S. Cl.
CPC ..... *B41J 11/002* (2013.01); *A45D 29/18* (2013.01)
USPC ..... 347/102; 132/73.5; 347/2

(58) Field of Classification Search
CPC combination set(s) only.
See application file for complete search history.

(56) References Cited

U.S. PATENT DOCUMENTS 6,286,517 B1 * 9/2001 Weber et al. ..... 132/73
2011/0315027 A1 * 12/2011 Bitoh ..... 101/35

FOREIGN PATENT DOCUMENTS

JP 63-095004 A 4/1988
JP 2000-0287744 A 10/2000
JP 2012-005666 A 1/2012
JP 2012010848 A * 1/2012

OTHER PUBLICATIONS

Japanese Office Action dated Feb. 4, 2014 (and English translation thereof) in counterpart Japanese Application No. 2012-054669.

* cited by examiner

*Primary Examiner* — Shelby Fidler
*Assistant Examiner* — Tracey McMillion
(74) *Attorney, Agent, or Firm* — Holtz Holtz Goodman & Chick PC

(57) ABSTRACT

A nail print apparatus including a dividing wall; a first finger inserting section which is provided in one space divided by the dividing wall and in which a finger is inserted; a print head which is provided in the one space divided by the dividing wall and performs printing on a nail part of the finger inserted in the first finger inserting section; a second finger inserting section which is provided in other space divided by the dividing wall and in which a finger is inserted; and a blowing section which blows air into the first finger inserting section and into the second finger inserting section.

12 Claims, 19 Drawing Sheets

NAIL PRINT APPARATUS INCLUDING BLOWING UNIT

BACKGROUND OF THE INVENTION

1. Field of the Invention

The present invention relates to a nail print apparatus including a blowing unit.

2. Description of Related Art

A nail print apparatus is a print apparatus in which printing fingers corresponding to nail parts to be printed are placed on a placement board provided in an apparatus main body and printing is performed on the nail parts of the printing fingers.

When nail printing is performed on the nail parts by such nail print apparatus, printed designs blur and become ruined if the nail parts contact with surroundings before the printed parts are dried.

With respect to this, conventionally, printed parts have been dried naturally or with a drier after printing is performed on the nail parts, for example. However, natural drying requires a long time until ink on the printed parts is dried completely that the ink does not attach to the surroundings. In addition, drying by using a drier or such like is troublesome because a user needs to perform the drying by himself or herself.

Thus, Japanese Patent Application Laid Open Publication No. 2000-287744 suggests an apparatus which includes a drying room provided with a blower or such like and can automatically perform nail printing and drying.

However, when drying operation such as blowing by a blower is performed near a finger which is being printed by a print head, for example, an ink ejecting section of the print head becomes dry and cannot eject the ink easily, disturbing the printing operation.

On the other hand, if drying is started after printing is completed for all the finger nails, it takes a long time to dry the ink on the printed parts completely and the fingers cannot move freely in the meantime.

The present invention has been made in consideration of the above matters and an object of the present invention is to provide a nail print apparatus which can dry printed parts in the shortest possible time without disturbing printing operation.

SUMMARY OF THE INVENTION

According to one aspect of the present invention, there is provided a nail print apparatus including a dividing wall, a first finger inserting section which is provided in one space divided by the dividing wall and in which a finger is inserted, a print head which is provided in the one space divided by the dividing wall and performs printing on a nail part of the finger inserted in the first finger inserting section, a second finger inserting section which is provided in other space divided by the dividing wall and in which a finger is inserted, and a blowing section which blows air into the first, finger inserting section and into the second finger inserting section.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

First Embodiment

The first embodiment of a nail print apparatus according to the present invention will be described with reference to FIGS. 1 to 18. The scope of the present invention is not limited to the following embodiment and illustrated examples though the embodiment described below is accompanied with various limitations which are technically preferable to perform the present invention.

Figure 1:
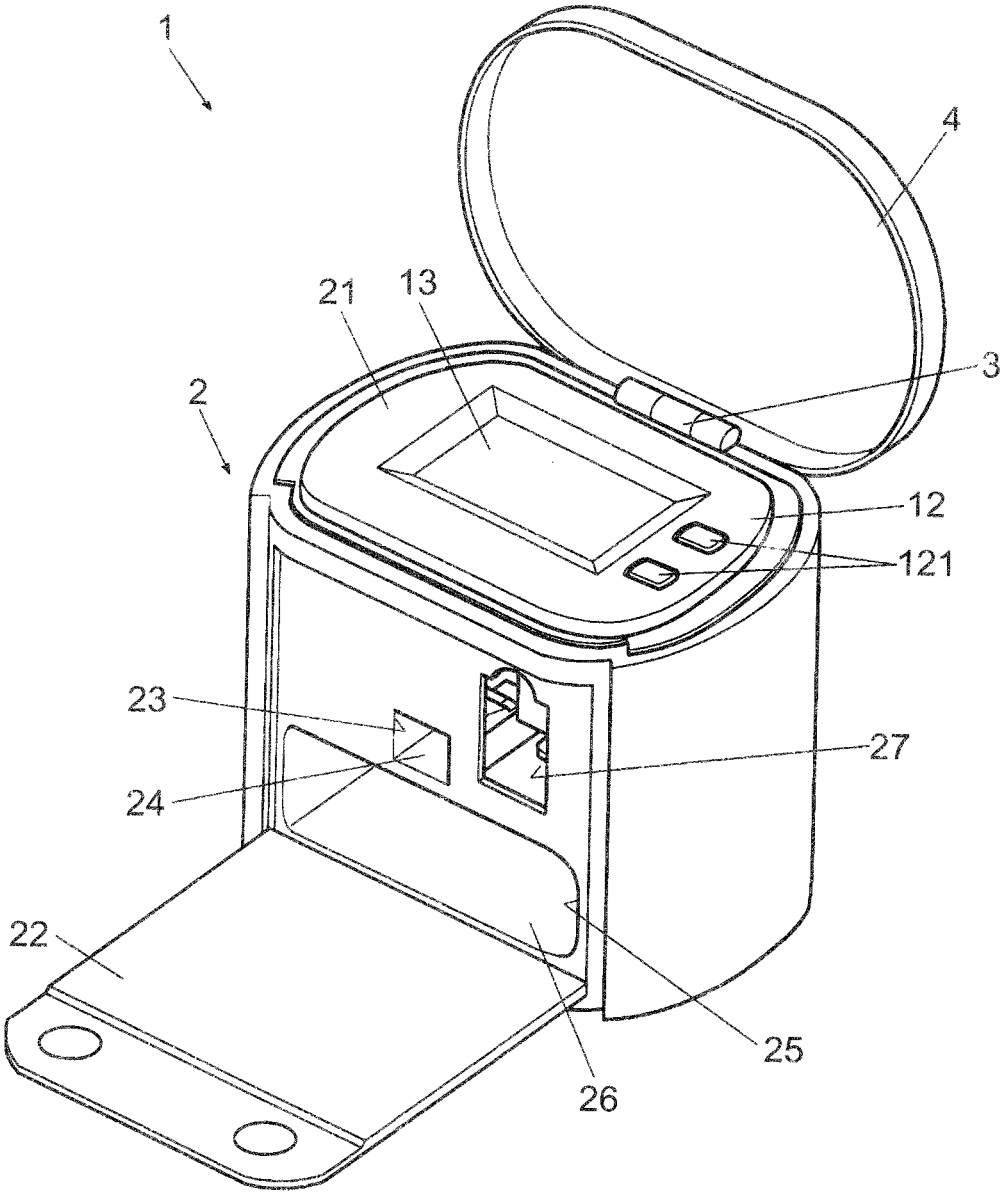
FIG. 1 is a schematic view conceptually showing an embodiment of a nail print apparatus according to the present invention and shows a state where a cover is open.
Figure 2:
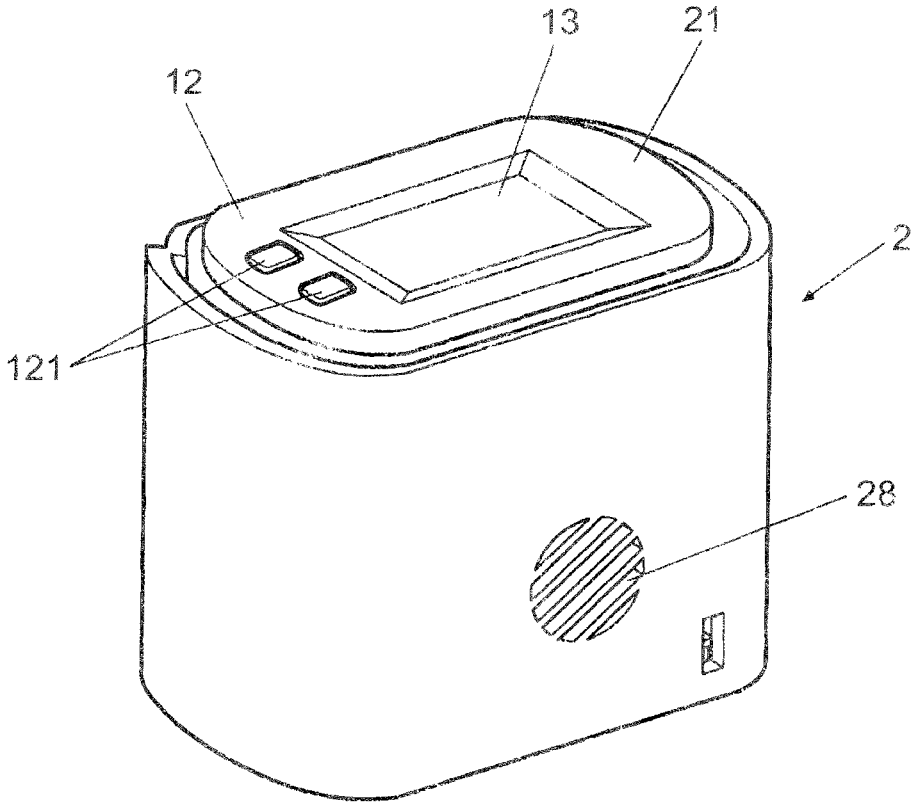
FIG. 2 is a schematic view of an apparatus main body of the nail print apparatus of FIG. 1 seen from the back side.

FIG. 1 is a schematic view showing an outer appearance of a nail print apparatus 1 seen from the front side in the embodiment and FIG. 2 is a schematic view showing an outer appearance of the nail print apparatus 1 seen from the back side. In FIG. 2 and the following figures, only an apparatus main body 2 of the nail print apparatus 1 is illustrated and a cover 4, an opening/closing plate 22 and others are omitted for convenience of illustration.

As shown in FIG. 1, the nail print apparatus 1 includes the apparatus main body 2 and the cover 4. The cover 4 is rotatably joined to the apparatus main body 2 via a hinge 3 which is provided at the back end portion of a top plate 21 which is the upper surface of the apparatus main body 2. The cover 4 is rotatable around the hinge 3 as a supporting point from a position of lying over the top plate 21 of the apparatus main body 2 so as to close to a position of standing from the top plate 21 of the apparatus main body 2 so as to open (see FIG. 1).

The above apparatus main body 2 is formed in an approximately oval shape in an overhead plan view. The opening/closing plate 22 is provided at the front side of the apparatus main body 2 so as to be able to flip up and down. The opening/closing plate 22 is joined to the apparatus main body 2 via a hinge (not shown in the drawings) which is provided at the lower end portion of the front surface of the apparatus main body 2. The opening/closing plate 22 is for opening and closing the front surface of the apparatus main body 2.

At a nearly central portion of the front surface of the apparatus main body 2, a printing finger inlet port 23 to insert a finger (hereinafter, called a "printing finger U1") corresponding to a nail part T which is a printing target is formed. The printing finger inlet port 23 leads to an after-mentioned first finger inserting section 24. Further, a non-printing finger inlet port 25 to insert fingers (hereinafter, called "non-printing fingers U2") corresponding to nail parts T which are not printing targets (that is, nail parts T which are waiting for printing and nail parts T which are already printed, for example) is formed under the printing finger inlet port 23 on the front surface of the apparatus main body 2. The non-printing finger inlet port 25 leads to an after-mentioned second finger inserting section 26.

In addition, a cartridge replacement port 27 for replacing a print head 46 (ink cartridge) of an after-mentioned printing section 40 is provided beside the printing finger inlet port 23 on the front surface of the apparatus main body 2.

Further, as shown in FIG. 2, an air intake port 28 which takes in outer air is provided at a position corresponding to a blower 63 (see FIG. 6, for example) such as a fan of a heated air blowing unit 60 on the back side of the apparatus main body 2.

Shapes and configurations of the apparatus main body 2 and the cover 4 are not limited to the examples illustrated here.

An operation section 12 is provided on the top plate of the apparatus main body 2.

On the operation section 12, operation buttons 121 such as a power switch button to turn on the nail print apparatus 1 and a stop button to stop operation in an emergency are disposed. The operation buttons 121 are not limited to the examples described here and there may be provided operation buttons 121 performing other various operations.

A display section 13 is provided at a nearly central portion on the top plate 21 of the apparatus main body 2. The display section 13 is configured by including a fiat display such as a LCD (Liquid Crystal Display) and an organic electroluminescent display, for example. On the display section 13 of the embodiment, an image of a photographed finger (hereinafter, called a "finger image"), an outline of a nail part T included in the finger image, an outline of the finger in the finger image, an image to be printed on the nail part T (that is, a design image), thumbnail images for confirming the design, an instruction screen to display various types of instructions, a notification screen, a warning screen and such like are appropriately displayed.

In the embodiment, a touch panel is integrally formed on a surface of the display section 13 and various types of input can be performed by touch operation of a stylus pen (not shown in the drawings) a fingertip or such like.

For example, on the display screen of the display section 13, various types of operation buttons (not shown in the drawings) such as a printing start switch button, a printing stop switch button to stop the printing operation and a design selection button for a user to select, a design image to be printed (that is, a desired design to be printed on the nail part T which is a printing target) are displayed. The user can carry out various types of input by touching the operation buttons on the display screen of the display section 13.

It is not essential to form a touch panel on a surface of the display section 13. When a touch panel is not formed on the surface of the display section 13, the above various operation buttons are provided on the operation section 12.

Figure 3:
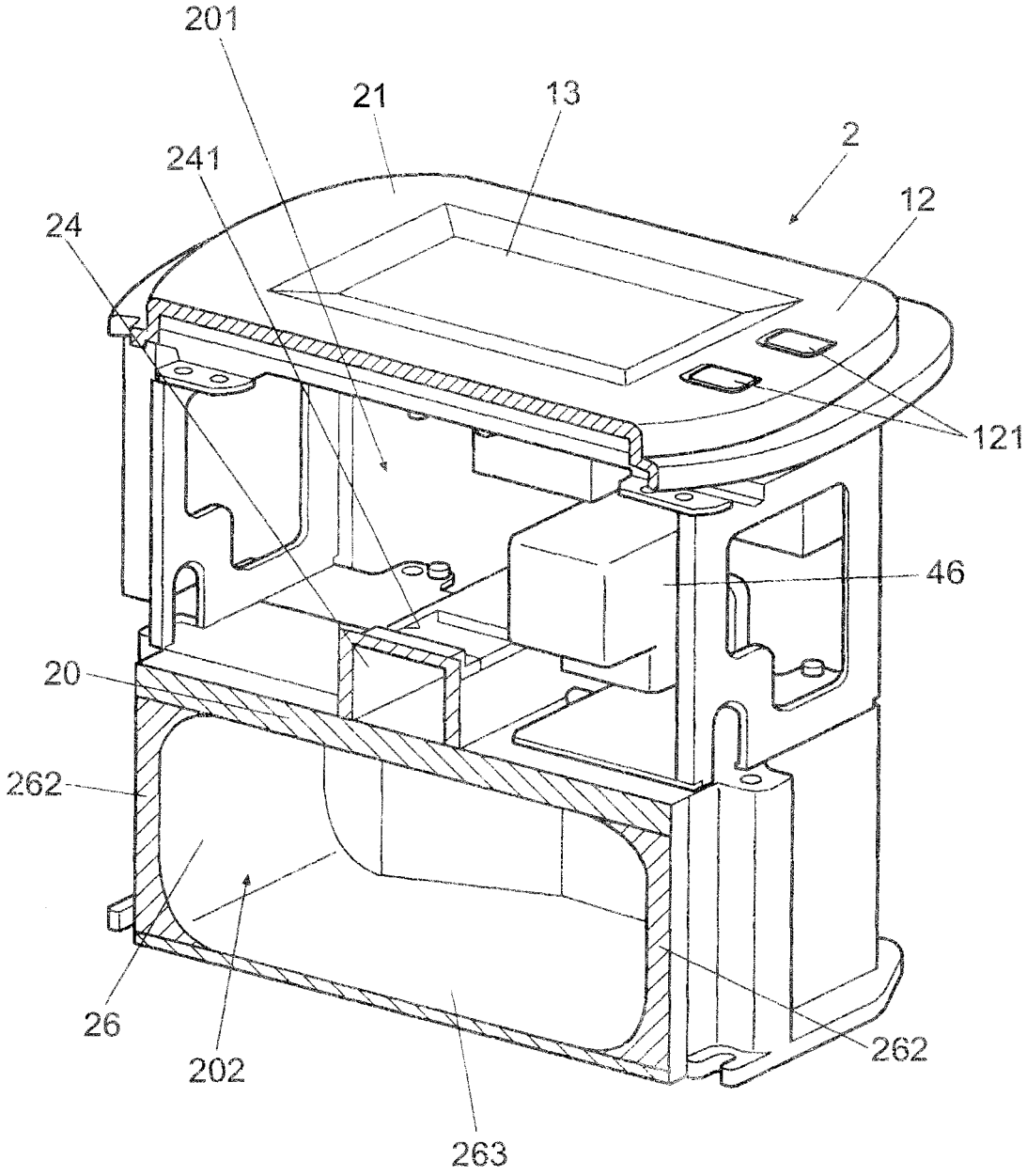
FIG. 3 is a main part schematic view showing an inside of an apparatus main body in which a part of the front surface is cut away.
Figure 4:
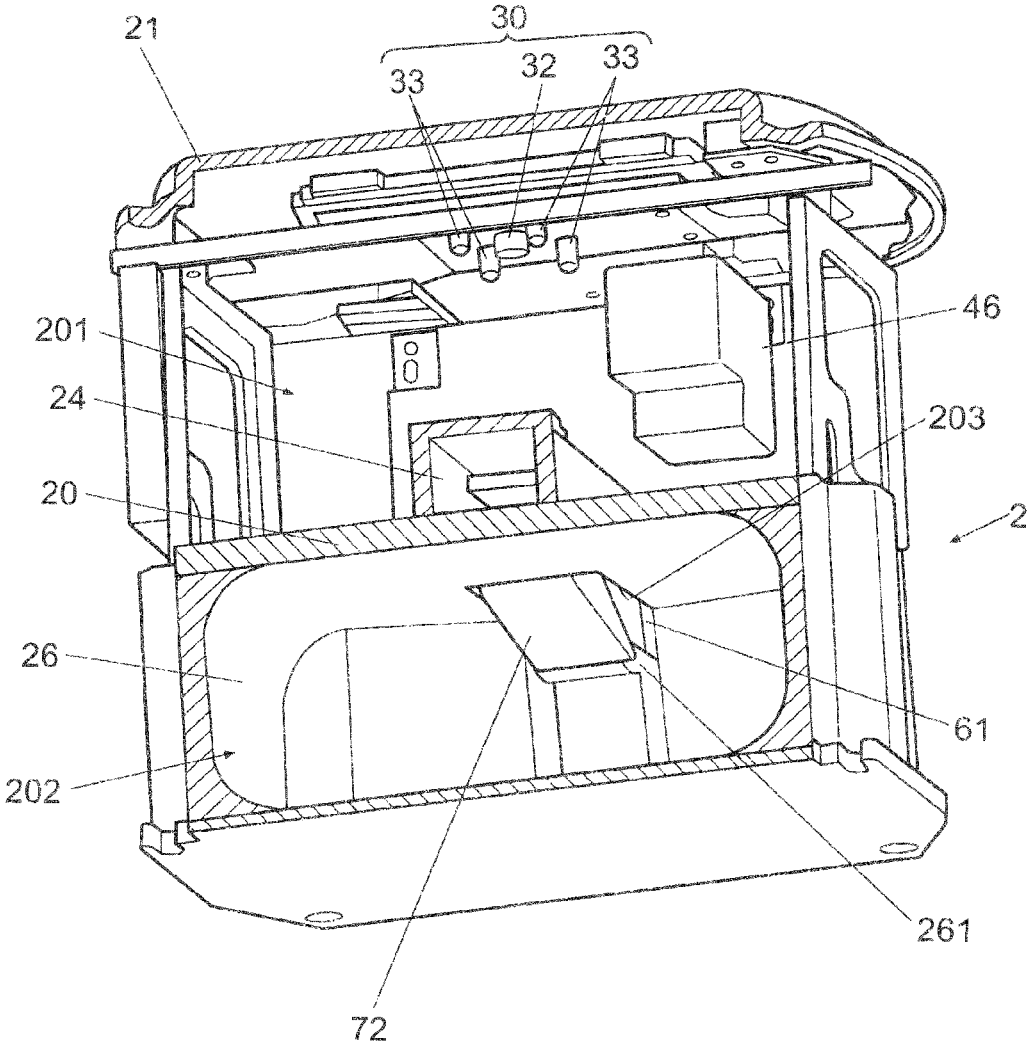
FIG. 4 is a main part schematic view showing an inside of an apparatus main body seen from obliquely downside in which a part of the front surface is cut away.

FIG. 3 is a main part schematic view showing an inside of the apparatus main body 2 in which a part of the front surface is cut away and FIG. 4 is a main part schematic view showing an inside of the apparatus main body 2 seen from obliquely downside in which a part of the front surface is cut away similarly as in FIG. 3.

As shown in FIGS. 3 and 4, a dividing wall 20 is provided inside the apparatus main body 2 in the embodiment. The dividing wall is a plate member which extends nearly laterally inside the apparatus main body 2 and divides the inside of the apparatus main body 2 into an upper containing section 201 and a lower containing section 202.

The first finger inserting section 24 to insert a finger (printing finger U1) corresponding to a nail part T which is a printing target is provided on one surface of the dividing wall 20. The first finger inserting section 24 is disposed on an upper side (upper side in FIGS. 3 and 4) of the dividing wall 20, that is, in the upper containing section 201 of the apparatus main body 2 and at a nearly central portion to a width direction of the nail print apparatus 1. The printing finger U1 is inserted in the first finger inserting section 24 through the printing finger inlet port 23.

In the nail print apparatus 1 of the embodiment, the printing finger U1 is inserted in the first finger inserting section 24 one by one and printing is performed on the nail part T of the printing finger U1, and thus the first finger inserting section 24 is formed to have a width that a finger of a person can be inserted. Also, the first finger inserting section 24 is formed to have a height that the printing finger U1 and the nail part T thereof do not contact with the first finger inserting section upper surface 240 when moving the printing finger U1 into or out from the first finger inserting section 24.

The first finger inserting section 24 extends from the printing finger inlet port 23 provided on the front surface of the apparatus main body 2 to a wall surface of the back side of the apparatus main body 2 and a window section 241 to expose the nail part T is formed on a part of the upper surface of the first finger inserting section 24.

Further, a second finger inserting section 26 to insert fingers (non-printing fingers U2) corresponding to the nail parts T which are not printing targets are provided on the other side of the dividing wall 20 (in the embodiment, the lower side in FIGS. 3 and 4, that is, in the lower containing section 202 of the apparatus main body 2). The non-printing fingers U2 are inserted in the second finger inserting section 26 through the non-printing finger inlet port 25. The second finger inserting section 26 includes the dividing wall 20 at the upper surface and is surrounded by the dividing wall 20, second finger inserting section side surfaces 262 and a second finger inserting section bottom surface 263.

Figure 5:
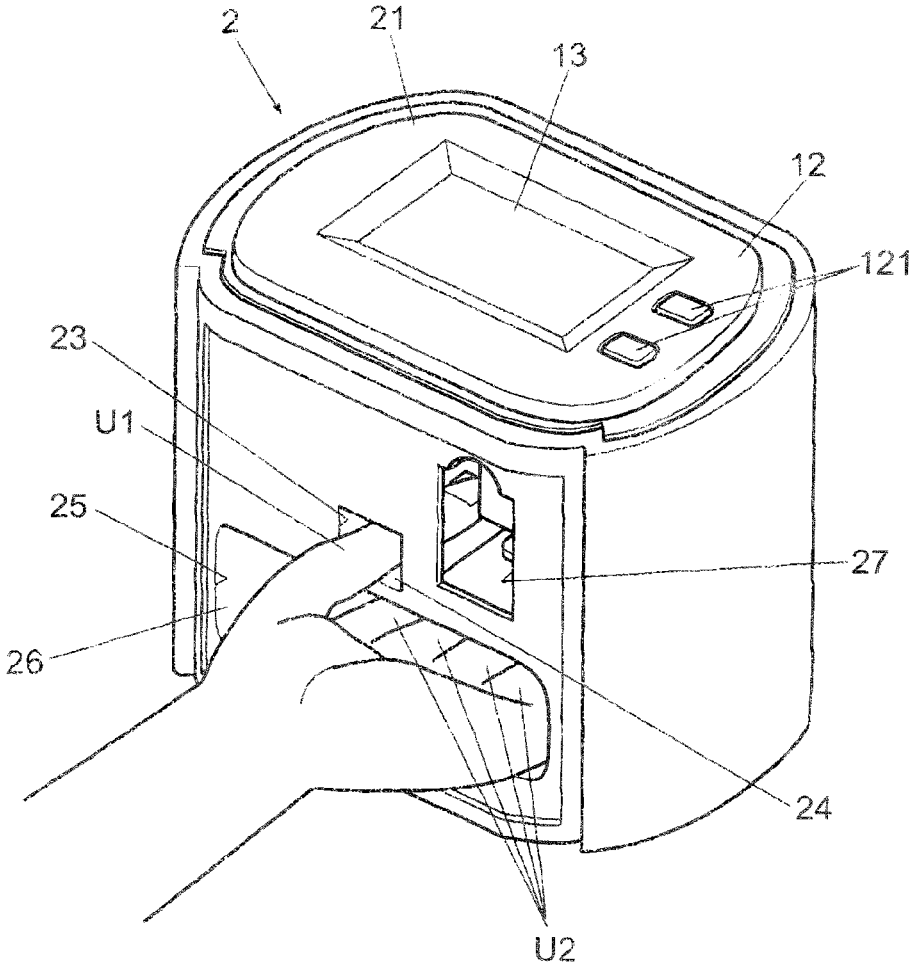
FIG. 5 is a schematic view of an apparatus main body in a state where a printing finger is inserted in a first finger inserting section and non-printing fingers are inserted, in a second finger inserting section.

For example, when printing is to be performed on a nail part T of a thumb, the thumb as the printing finger U1 is inserted in the first finger inserting section 24 and the other four fingers (index finger, middle finger, ring finger and little finger) which are the non-printing fingers U2 are inserted in the second finger inserting section 26 as shown in FIG. 5.

As shown in FIG. 4, for example, the back portion, in the finger inserting direction, of the dividing wall 20 which forms the bottom surface of the first finger inserting section 24 is cut away and the second finger inserting section 26 communicates with the first finger inserting section 24 through the cut-away section 203 of the dividing wall 20.

In the back side, in the finger inserting direction, of the second finger inserting section 26, a valve locking section 261 which can lock an after-mentioned switching valve 72 is provided at a position corresponding to the cut-away section 203 of the dividing wall 20.

Further, on the back surface of the apparatus main body 2, a duct 61 communicating with the air intake port 28, the first finger inserting section 24 and the second finger inserting section 26 is provided in the back side, in the finger inserting direction, of the first finger inserting section 24 and the second finger inserting section 26.

Figure 6:
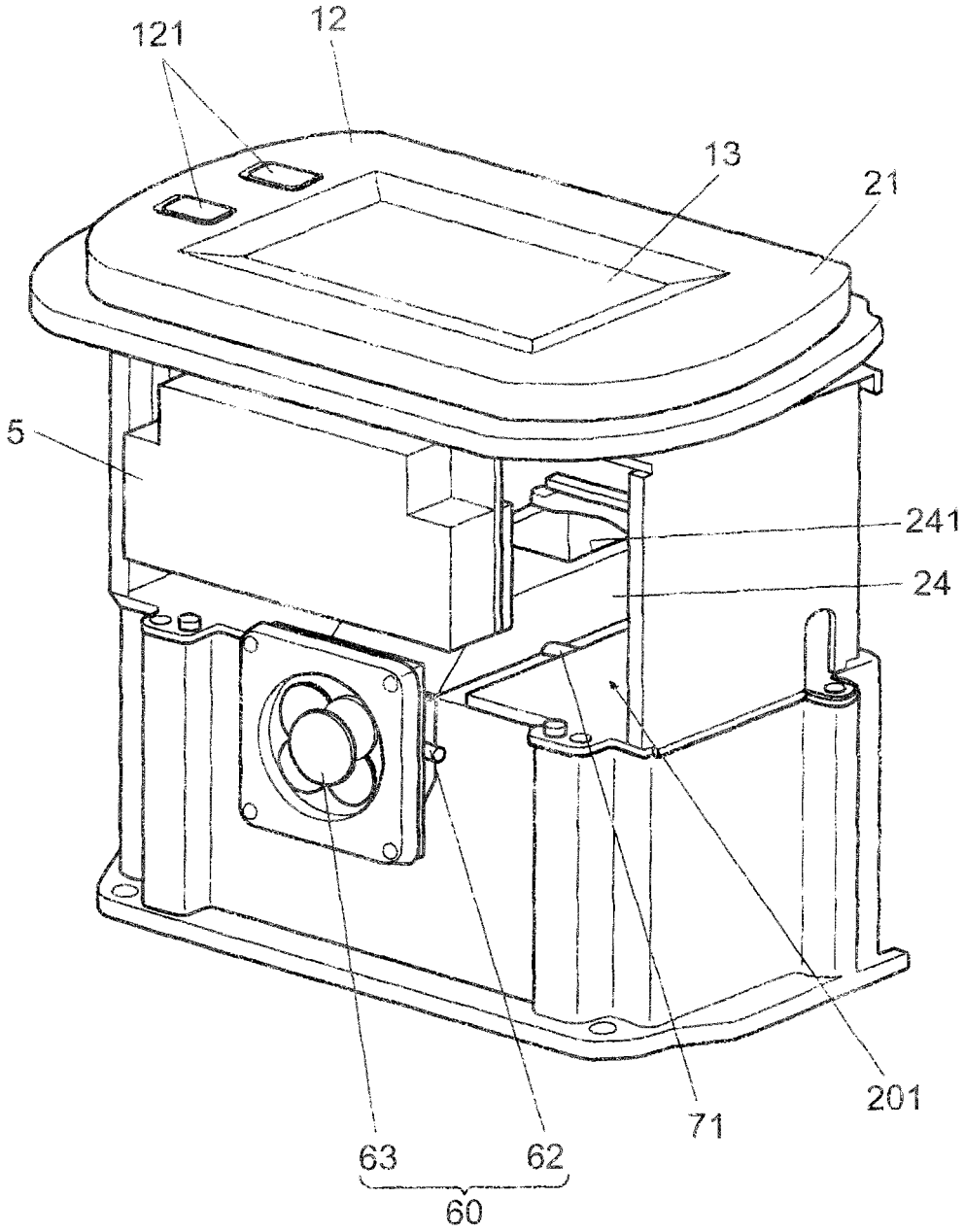
FIG. 6 is a schematic view of an apparatus main body seen from the back side in which an outer wall is taken away.
Figure 7:
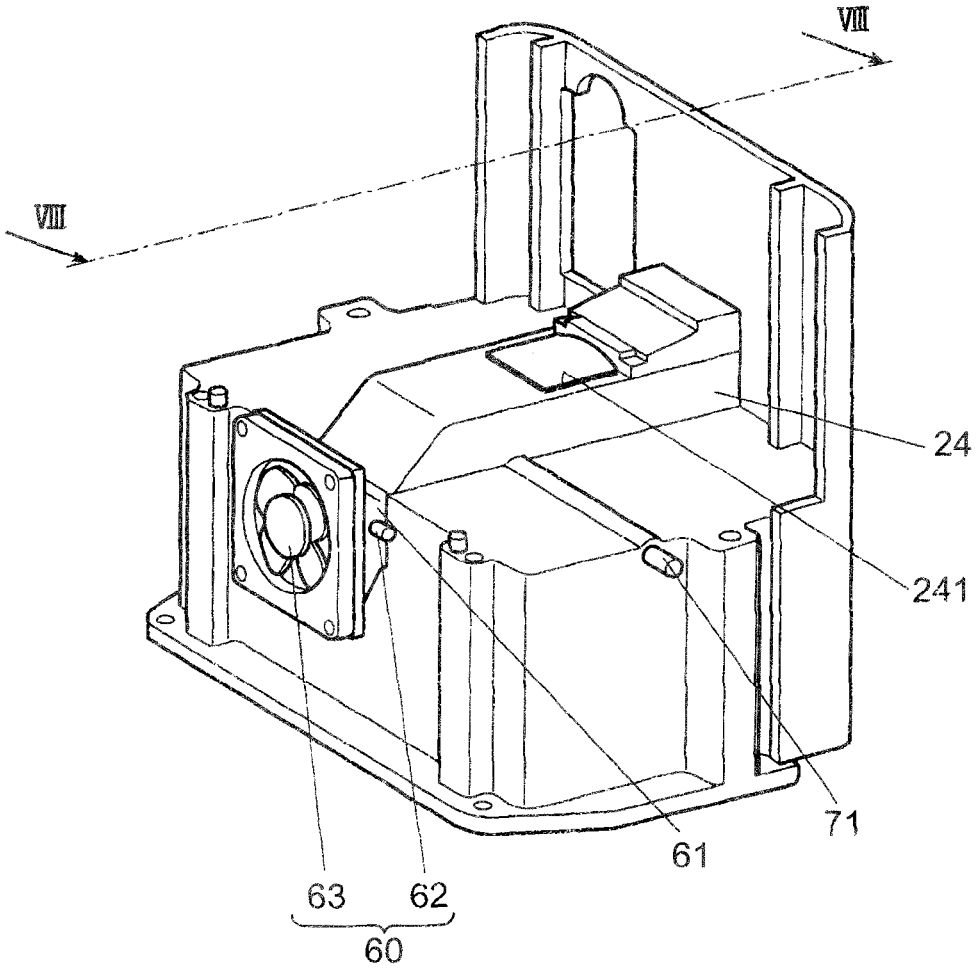
FIG. 7 is a main part schematic view of the apparatus main body shown in FIG. 6 in which a top plate and various members disposed in an upper containing section are taken away.

FIG. 6 is a schematic view showing an inner configuration of the apparatus main body 2 seen from the back side in which an outer wall is taken away from the apparatus main body 2 and FIG. 7 is a main part schematic view of the apparatus main body 2 shown in FIG. 6 in which a top plate and various members disposed in the upper containing section 201 are taken away.

As shown in FIGS. 6 and 7, the heated air blowing unit 60 including a heater 62 and the blower 63 which blows air heated by the heater 62 into the first finger inserting section 24 and into the second finger inserting section 26 is disposed in the back side, in the finger inserting direction, of the dividing wall 20 inside the apparatus main body 2.

In the embodiment, the heated air blowing unit 60 is disposed inside the duct 61 communicating with the first finger inserting section 24 and the second finger inserting section 2, in the back surface side of the apparatus main body 2, and the upper and both lateral sides of the heated air blowing unit 60 are enclosed with the duct 61. Thus, warm air from the heated air blowing unit 60 is not blown into the upper containing section 201 other than the first finger inserting section 24.

The heater 62 is an electric heater of a coiled heating wire such as nichrome wire, for example, and the heater 62 can heat the surrounding air when turned on. The heater 62 only needs to be a compact type which can be incorporated to the nail print apparatus 1 and the configuration thereof is not limited to the example illustrated here.

The blower 63 is a blowing fan which is disposed at a position corresponding to the air intake port 28 and external air can be taken in through the air intake port 28 by operating the blower 63.

The heated air blowing unit 60 is connected to a drying control section 513 (see FIG. 17) of an after-mentioned control device 50 and the drying control section 513 controls heating temperature and heating time of the heater 62 and blowing amount (that is, strength of blowing) and blowing time of the blower 63.

Figure 8:
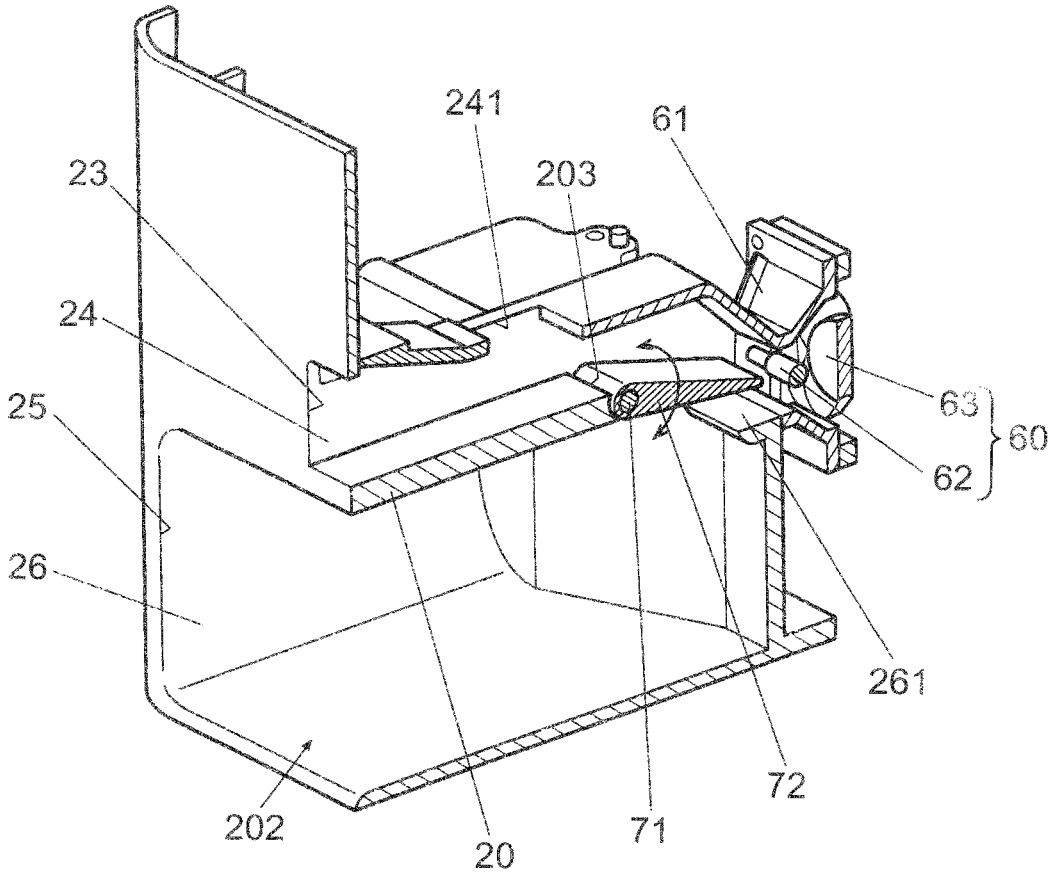
FIG. 8 is a sectional view of FIG. 7 cut along the line VIII-VIII.
Figure 9:
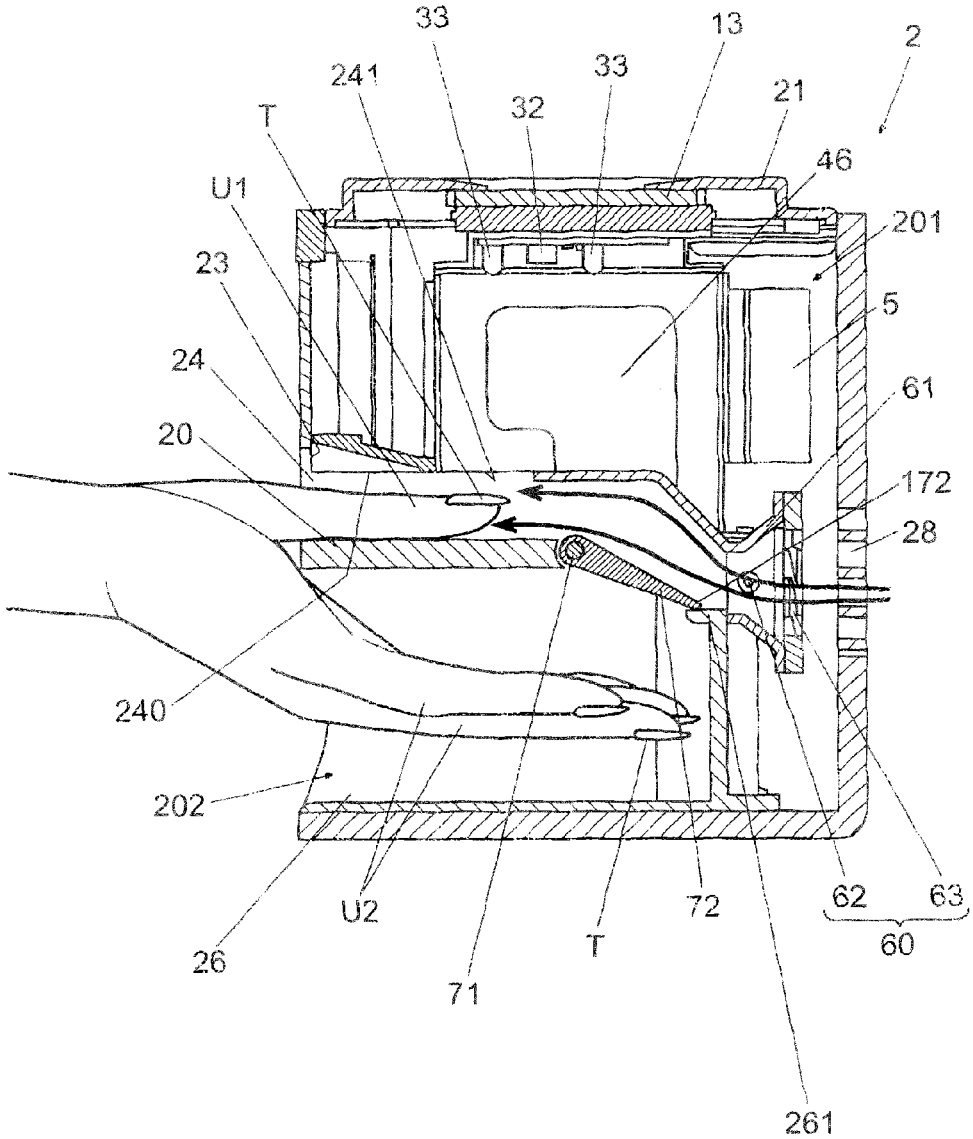
FIG. 9 is a sectional side view showing a state of a switching valve located at a first position.
Figure 10:
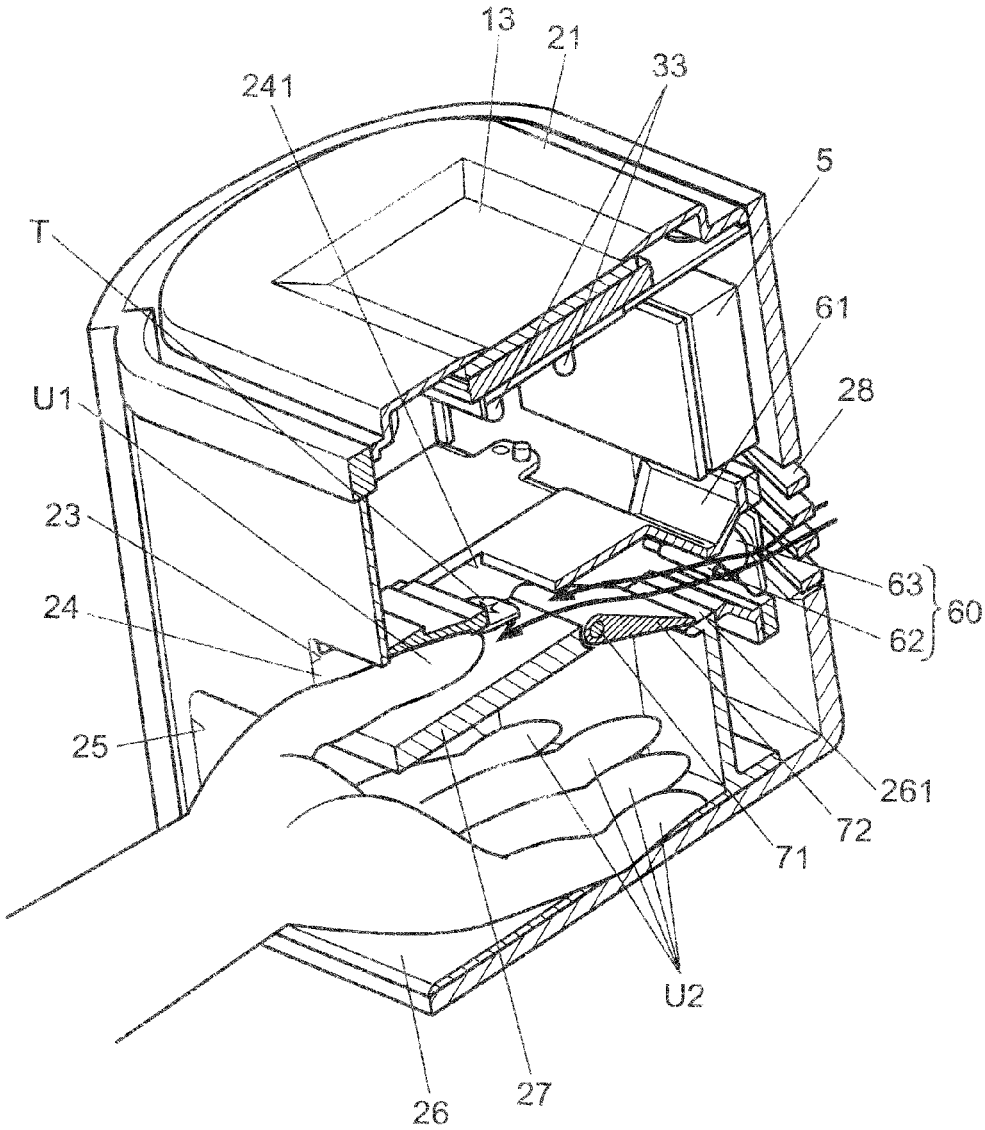
FIG. 10 is a sectional schematic view showing a state of a switching valve located at a first position.
Figure 11:
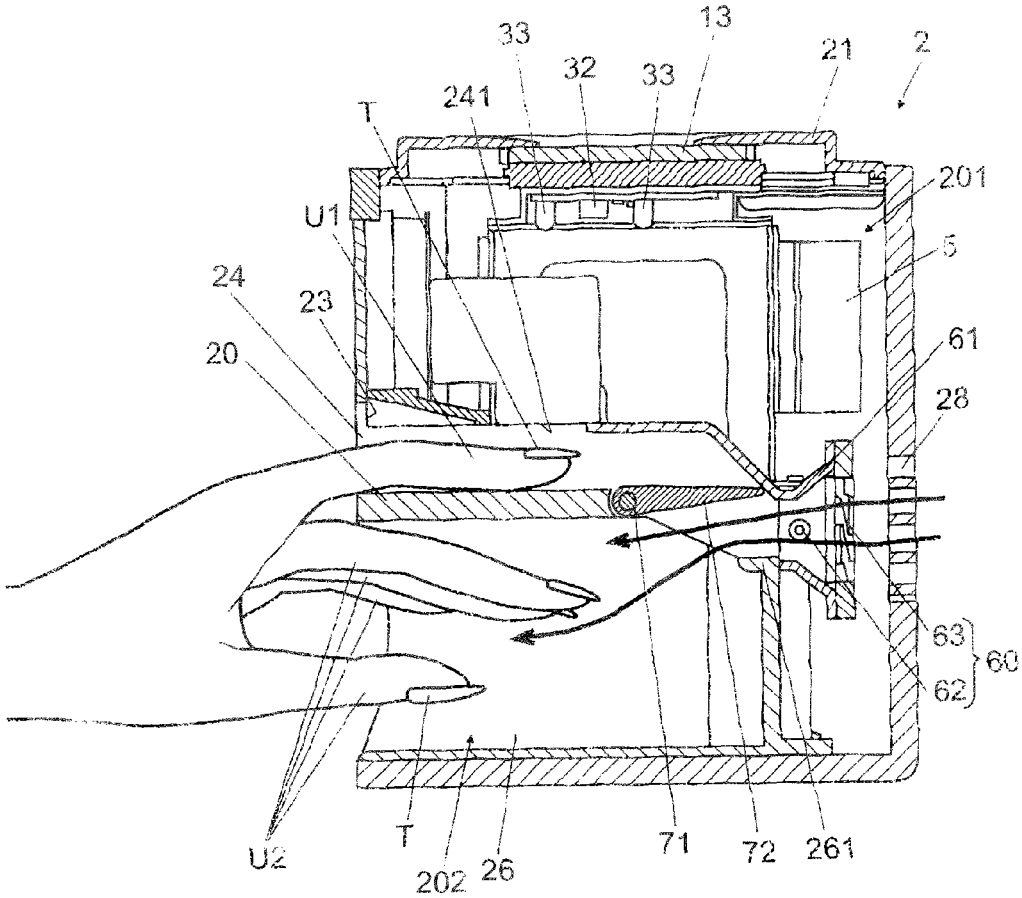
FIG. 11 is a sectional side view showing a state of a switching valve located at a third position during printing.
Figure 12:
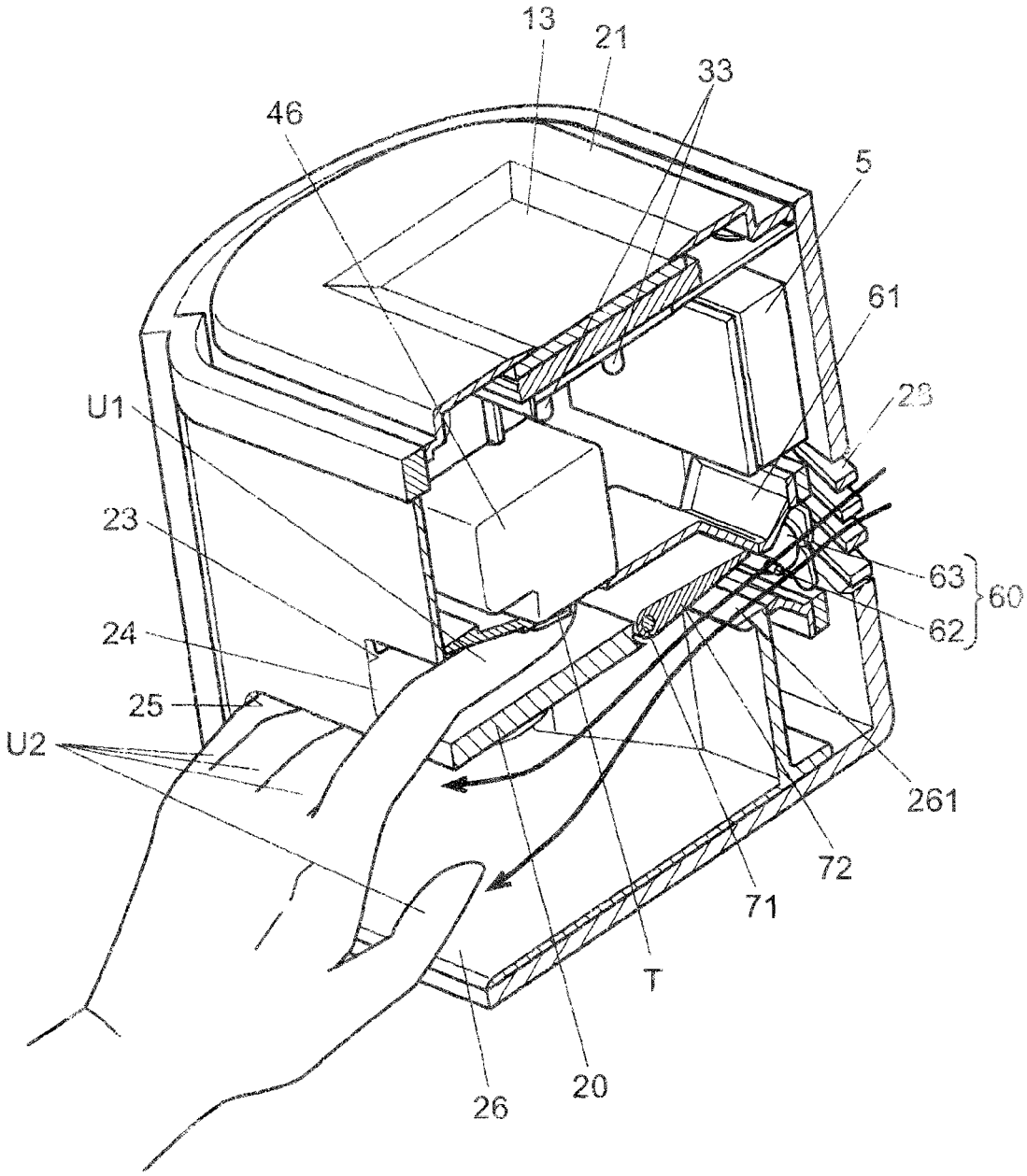
FIG. 12 is a sectional schematic view showing a state of a switching valve located at a third position during printing.
Figure 13:
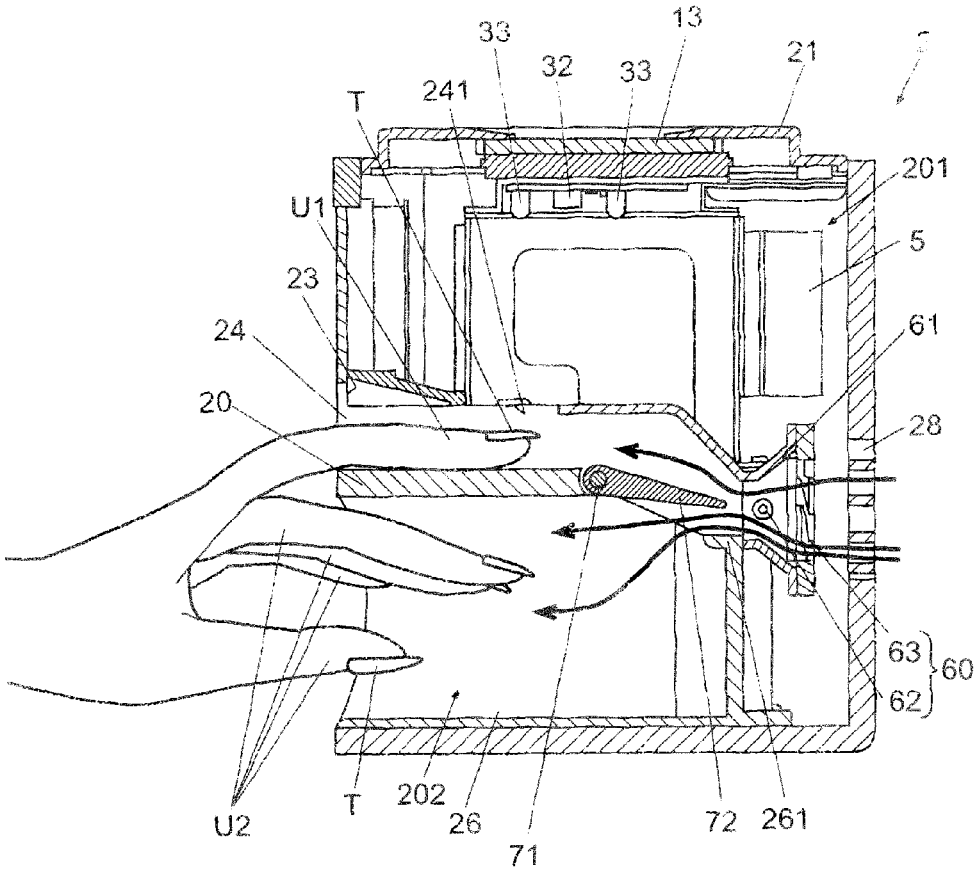
FIG. 13 is a sectional side view showing a state of a switching valve located at a second position.
Figure 14:
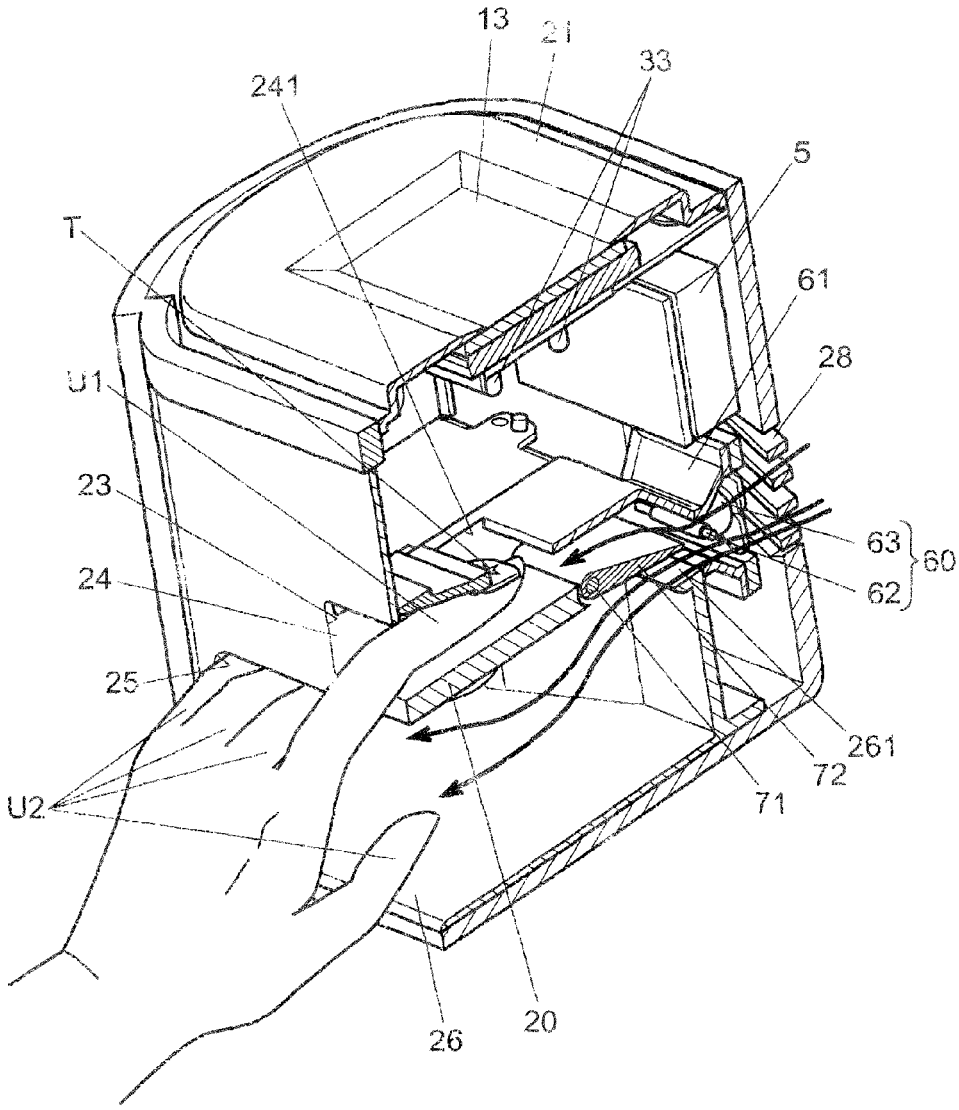
FIG. 14 is a sectional schematic view showing a state of a switching valve located at a second position.
Figure 15:
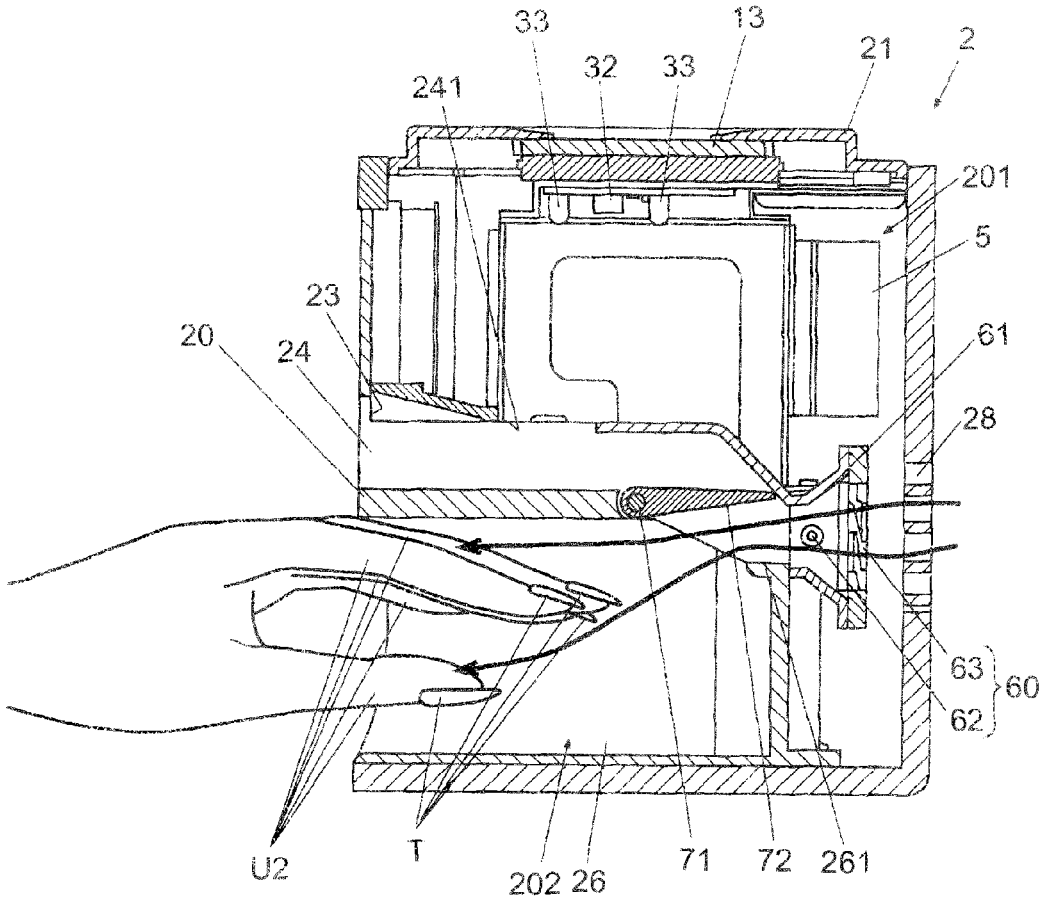
FIG. 15 is a sectional side view showing a state of a switching valve located at a third position after printing is finished for all the fingers.
Figure 16:
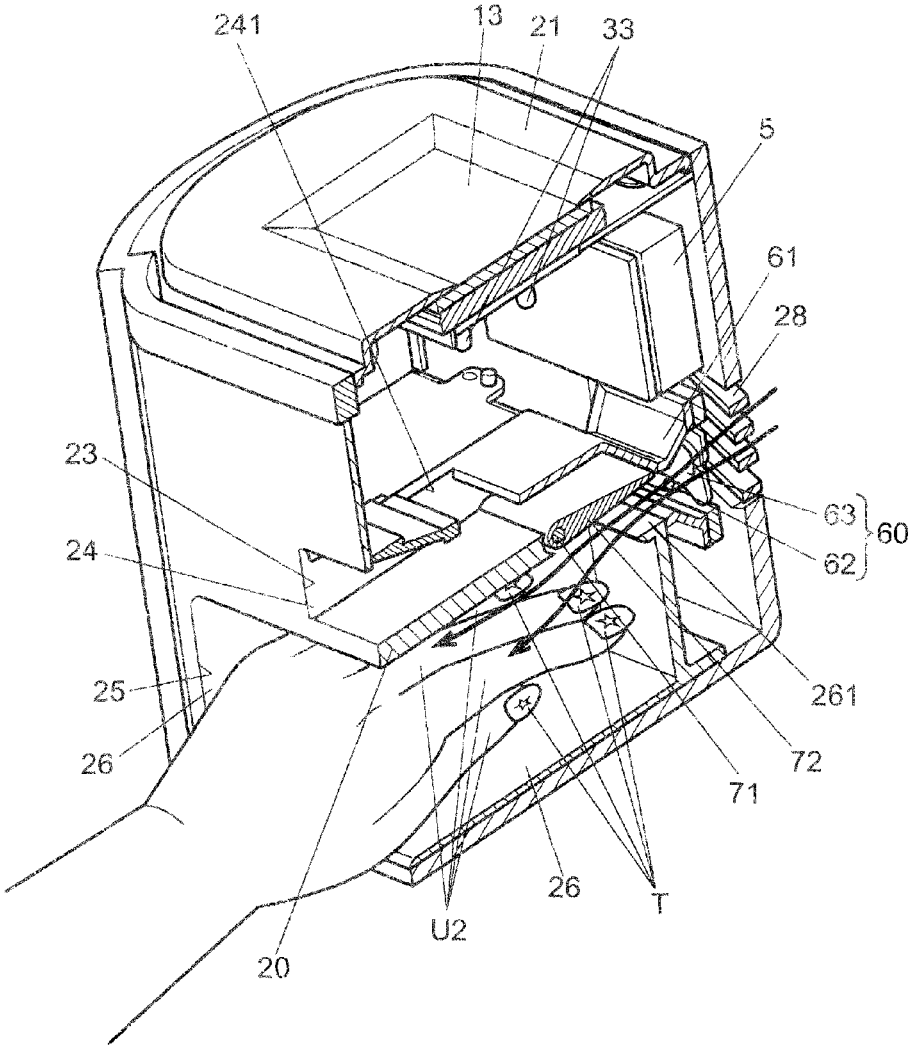
FIG. 16 is a sectional schematic view showing a state of a switching valve located at a third position after printing is finished for all the fingers.

FIG. 8 is a sectional view of FIG. 7 cut along the line VIII-VIII seen from the front side of the nail print apparatus 1.

As mentioned above, the back portion, in the finger inserting direction, of the dividing wall 20 which forms the bottom of the first finger inserting section 24 is cut away to form the cut-away section 203. As shown in FIG. 8, a shaft 71 is rotatably provided at the end portion of the cut-away section 203 of the dividing wall 20 so as to extend in the width direction of the nail print apparatus. The switching valve 72 which is formed so as to have an approximately same width as the width of the first finger inserting section 24 (that is, the width of the cut-away section 203 of the dividing wall 20) is attached to the shaft 71. In the embodiment, the switching valve 72 functions as a blowing adjustment section which adjusts blowing into the first finger inserting section 24 and the blowing into the second finger inserting section 26 by the heated air blowing unit 60. The shape, size and such like of the switching valve 72 are not limited to the example illustrated here as long as the switching valve 72 can adjust blowing by the heated air blowing unit 60.

A valve driving motor 73 (see FIG. 17) which is a driving source is connected to the shaft 71, and the switching valve 72 is configured so as to rotate vertically (vertically to the apparatus in FIGS. 3 and 4, for example) around the axis of the shaft 71 by the driving force from the valve driving motor 73 transmitted to the switching valve 72 through the shaft 71 (see FIG. 8).

The valve driving motor 73 which operates the switching valve 72 is connected to an after-mentioned valve driving control section 514 (see FIG. 17) of the control device 50 and controlled by the valve driving control section 514.

Controlled by the valve driving control section 514, the switching valve 72 can stop at a plurality of positions where blowing amount by the heated air blowing unit 60 in the first finger inserting section 24 and in the second finger inserting section 26 is different for each position.

In the embodiment, the switching valve 72 can be located at a first position (see FIGS. 9 and 10) where a free end 172 of the switching valve 72 contacts with the valve locking section 261 in the second finger inserting section 26, a second position (see FIGS. 13 and 14) where the free end 172 of the switching valve 72 is located between the valve locking section 261 in the second finger inserting section 26 and the upper surface of the first finger inserting section 24 (that is, the location where the free end 172 of the switching valve 72 does not contact either with the valve locking section 261 or with the upper surface of the first finger inserting section 24) or the third position (see FIGS. 11, 12, 15 and 16) where the free end 172 of the switching valve 72 contacts with the upper surface of the first finger inserting section 24.

When the switching valve 72 is located at the first position, blowing from the heated air blowing unit 60 into the second finger inserting section 26 is blocked and blowing from the heated air blowing unit 60 is performed into the first finger inserting section 24 only.

When the switching valve 72 is located at the second position, adjustment is made so that blowing is performed from the heated air blowing unit 60 to both of the first finger inserting section 24 and the second finger inserting section 26. Here, blowing amount in the first finger inserting section 24 and in the second finger inserting section 26 may be adjusted by adjusting the vertical direction of the switching valve 72.

When, the switching valve 72 is located at the third position, blowing from the heated air blowing unit 60 into the first finger inserting section 24 is blocked and blowing is performed from the heated air blowing unit 60 into the second finger inserting section 26 only.

The upper containing section 201 of the apparatus main body 2 is provided with a photographing section 30, a printing section 40 including printing means, a control substrate 5 and others.

The photographing section 30 is a photographing means which photographs the printing finger U1 inserted in the first finger inserting section 24 and the nail part T thereof. The photographing section 30 is configured by including a camera 32 and lights 33.

The camera 32 is disposed on the underside of the top plate of the apparatus main body 2 so that the camera 32 can photograph the nail part T exposed in the window section 241 of the first finger inserting section 24. A camera of approximately two million pixels or more which includes a built-in, driver is applied as the camera 32, for example.

The lights 33 are configured by including white LEDs such like and perform lighting in photographing of the nail part T or others by the camera 32. In the embodiment, four lights 33 are disposed so as to surround the camera 32 as shown in FIG. 4.

The photographing section 30 is connected to and controlled by an after-mentioned photographing control section 511 of the control device 50.

As described later, in the nail print apparatus 1 of the embodiment, the control section 51 detects and measures the location, shape and such like of the nail part T which is a printing target from the image obtained by the photographing section 30. Also, the control section 51 determines whether a finger is inserted in the first finger inserting section 24, whether the printing finger U1 is located at an appropriate position for printing (that is, the position where the entire nail part T is exposed at the window section 241 of the first finger inserting section 24) and such like on the basis of the image obtained by the photographing section 30. Further, when a user inserts the printing finger U1 in the first finger inserting section 24, the inside of the first finger inserting section 24 is photographed by the photographing section 30 and the obtained image is displayed on the display screen of the display section 13. The user can insert the printing finger U1 into a position appropriate for printing by checking the screen during the insertion.

The configuration, location and such like of the photographing section 30 is not limited to the example illustrated here.

The printing section 40 is a printing means which is provided on one side (the upper side in FIGS. 3 and 4 in the embodiment) of the dividing wall 20 and performs printing of color and pictures on a nail part T of the finger (printing finger U1) inserted in the first finger inserting section 24.

The printing section 40 includes a print head 46, a head holder (not shown in the drawings) which detachably holds the print head 46, a motor 47 (see FIG. 17) for moving the print head 46 set by the head holder in a scanning direction (for example, in the width direction or right and left direction of the nail print apparatus 1) and in a direction orthogonal to the scanning direction (that is, front and back direction), a guide rod (not shown in the drawings) which guides the print head 46, and others.

The print head 46 is joined to a motor 47 via a power transmission unit (various gears, for example) which is not shown in the drawings and moves back and forth or left and right sliding along the guide rod by the forward-reverse rotation of the motor 47.

In the embodiment, the print head 46 is an ink-jet type print head which makes ink be in the form of micro droplets and directly sprays the ink droplets onto a target to be printed (that is, the nail part T) to perform printing. Here, the recording method of the print head 46 is not limited to the ink-jet type.

The print head 46 of the embodiment is an integrated print head in which a nozzle plate (not shown in the drawings) including a plurality of ink ejecting ports and an ink cartridge storing ink and supplying the ink to the ink ejecting ports as needed are integrally formed. The print head 46 can be removed from the head holder by being pushed clown in the front (that is, toward the front side of the nail print apparatus 1). When there is no ink left, a user can remove the print head 46 from the cartridge replacement port 27, put a new print head 46 in the apparatus through the cartridge replacement port 27 and load the new print head 46 onto the head holder.

The print head 46 and the motor 47 of the printing section 40 are connected to and controlled by an after-mentioned printing control section 512 of the control device 50.

The control substrate 5 is disposed on a back surface, in the finger inserting direction, of the upper containing section 201. Various types of electronic components included in the control device 50 controlling the sections of the nail print apparatus 1 in the embodiment are installed in the control substrate 5.

Figure 17:
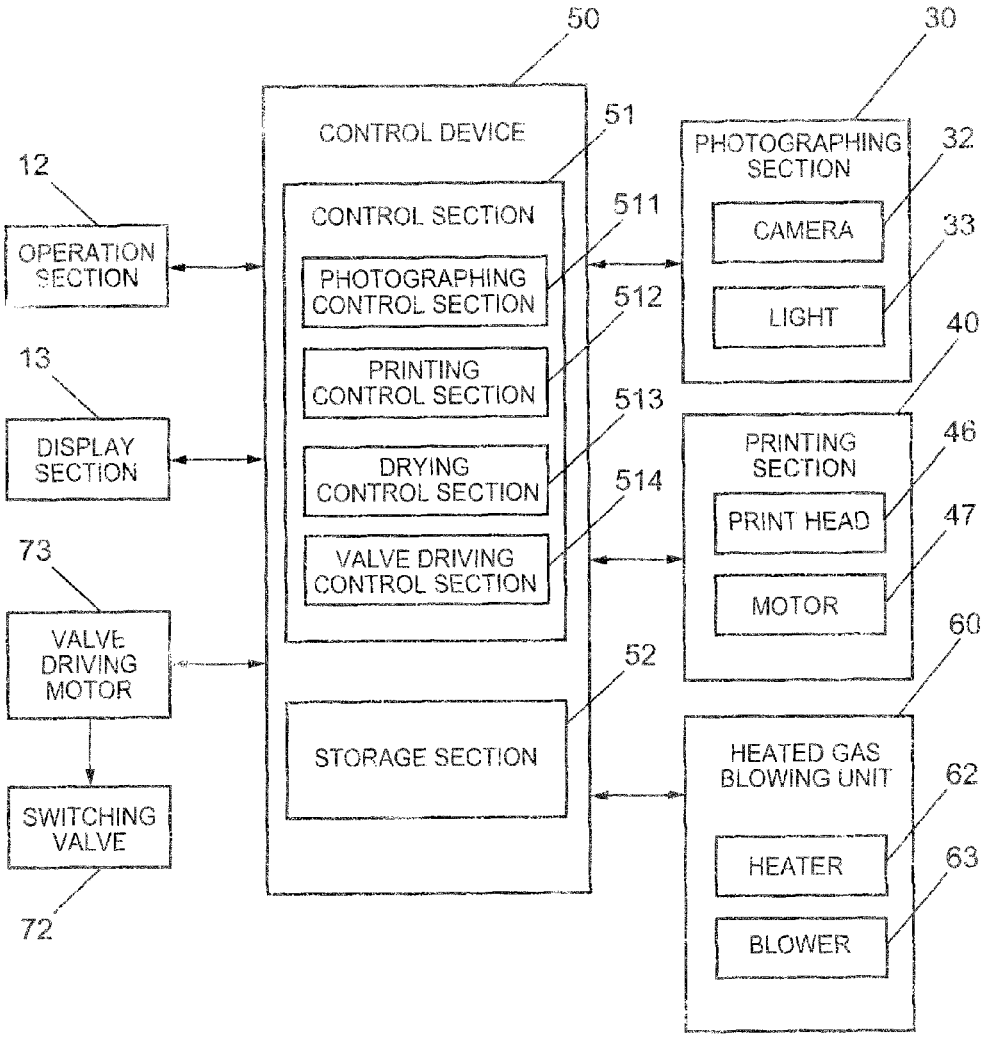
FIG. 17 is a main part block diagram of a nail print apparatus of a first embodiment.

FIG. 17 is a main part block diagram showing a control structure of the embodiment.

As shown in FIG. 17, the control device 50 is a computer which includes a control section 51 including CPU (Central Processing Unit) which is not shown in the drawings and others and a age section 52 including ROM (Read Only Memory), RAM (Random Access Memory) and others. In the storage section 52, various programs for operating the nail print apparatus 1, various data such as print data of design images and others are stored. The storage section of the nail print apparatus 1 is not limited to the storage section 52 (ROM and RAM) inside the control device 50 and may be provided in different locations.

In terms of function, the control section 51 includes a photographing control section 511, a printing control section 512, a drying control section 513, a valve driving control section 514 and such like. The function as the photographing control section 511, the printing control section 512, the drying control section 513, the valve driving control section 514 and such like is achieved by cooperation between CPU and programs stored in ROM or such like of the storage section 52. The functional sections included in the control section 51 are not limited to the sections described here and the control section 51 may include a functional section such as a nail region detecting section which detects a region of the nail part T from the finger image, for example.

The photographing control section 511 controls photographing operation of the photographing section 30 so as to obtain images of the printing finger U1 and the nail part T thereof of a user.

In the embodiment, the photographing control section 511 controls the photographing section 30 to obtain an image of the printing finger U1 inside the first finger inserting section 24 when the user sets the printing finger U1 in the first finger inserting section 24 before starting the printing, for example.

The printing control section 512 controls printing operation of the printing section 40 which is a printing means so as to perform printing on the nail part T on the basis of printing data of a design image.

The drying control section 513 controls heating temperature and heating time of the heater 62 and the blowing amount (that is, strength of blowing) and blowing time of the blower 63 of the heated air blowing unit 60, for example.

In the embodiment, three modes of pre-drying mode, parallel drying mode and real drying mode are prepared as operation modes (drying modes) of the heated air blowing unit 60, and the drying control section 513 controls the heater 62 and the blower 63 to make the heating temperature, blowing amount and such like suitable for each of the modes.

Here, the pre-drying mode is a mode of performing pre-drying on the nail part T of the printing finger U1 on which printing is completed before removing the printing finger U1 from the first finger inserting section 24 in a case where no other finger is printed yet.

In the pre-drying mode, the drying control section 513 adjusts the heating temperature of the heater 62 to "LOW" (the heating temperature from 30 to 35 degrees, for example), adjusts the blowing by the blower 63 to the middle level and the driving time of the heater 62 and the blower 63 to 5 to 10 seconds.

The pre-drying mode is a mode of drying to a level where the surface of the printed nail part T becomes dry. By performing pre-drying before removing the printing finger U1 after printing from the first finger inserting section 24, the printed image hardly blurs or becomes ruined even when the printed portion contacts with an apparatus wall surface or such like when removing the printing finger U1 from the first finger inserting section 24 or moving the printing finger U1 to the second finger inserting section 26.

As described later, in the pre-drying mode, the switching valve 72 is located at the first position (see FIGS. 9 and 10) where the free end 172 of the switching valve 72 contacts with the valve locking section 261 of the second finger inserting section 26 by the valve driving control section 514 controlling the valve driving motor.

The parallel drying mode is a mode of drying a nail part T of a printed finger (non-printing finger U2) inserted in the second finger inserting section 26 to some extent in parallel with performing pre-drying on the printed nail part T of the printing finger U1 on which printing is completed before removing U1 from the printing finger inserting section 24 in a case where a finger which is already printed is inserted in the second finger inserting section 26.

In the parallel drying mode, the drying control section 513 adjusts the heating temperature of the heater 62 to "HIGH" (the heating temperature from 40 to 45 degrees, for example), adjusts the blowing by the blower 63 to weak (blowing amount is small) and the driving time of the heater 62 and the blower 63 to 5 to 10 seconds.

The parallel drying mode is for drying the nail T of the non-printing finger U2 which is already printed and inserted in the second finger inserting section 26 as much as possible in addition to drying the surface of the printed nail part T in the first finger inserting section 24. In the parallel drying mode, the heating temperature of the heater 62 is set to "HIGH", however, the blowing by the blower 63 is set to weak to reduce the blowing amount. Therefore, the same effect as in the pre-drying on the nail part T of the printing finger U1 in the first finger inserting section 4 can be obtained. Further, the printed nail part T can be dried earlier since the nail part T of the non-printing finger U2 which is already printed is also dried in parallel with the above drying.

As described later, in the parallel drying mode, the switching valve 72 is located at the second position (see FIGS. 13 and 14) where the free end 172 of the switching valve 72 is located between the valve locking section 261 of the second finger inserting section 26 and the upper surface of the first finger inserting section 24 by the valve driving control section 514 controlling the valve driving motor.

The real drying mode is a mode of drying the nail part T of the printed finger (non-printing finger U2) inserted in the second finger inserting section 26 until the printing is completely dried.

In the real drying mode, the drying control section 513 adjusts the heating temperature of the heater 62 to "HIGH" (the heating temperature from 40 to 45 degrees, for example), adjusts the blowing by the blower 63 to strong (blowing amount is large) and the driving time of the heater 62 and the blower 63 to 20 to 30 seconds.

The real drying mode is for completely drying the printing on the nail part T of the non-printing finger U2 which is already printed and inserted in the second finger inserting section 26. The real drying mode is performed when the printed finger is inserted in the second finger inserting section 26 and the nail part T of the printing finger U1 inserted in the first finger inserting section 24 is being printed (see FIGS. 11 and 12) or when printing is completed for all the fingers and all the fingers are inserted in the second finger inserting section 26 (see FIGS. 15 and 16).

As described later, in the real drying mode, the switching valve 72 is located at the third position (see FIGS. 11, 12, 15 and 16) where the free end 172 of the switching valve 72 contacts with the upper surface of the first finger inserting section 24 by the valve driving control section 514 controlling the valve driving motor.

The specific contents of the pre-drying mode, parallel drying mode and real drying mode as operation modes of the heated air blowing unit 60 are not limited to the examples illustrated here. For example, though both of the blowing amount and the blowing time of the blower 63 are changed for each mode in the above example, the dry level may be adjusted by changing only the blowing time without changing the blowing amount or by changing only the blowing amount without changing the blowing time.

The valve driving control section 514 adjusts the angle of the switching valve 72 corresponding to the operation mode of the heated air blowing unit 60 (that is, three drying modes of pre-drying mode, parallel drying mode and real drying mode) by controlling the valve driving motor 73.

That is, as mentioned above, in the pre-drying mode, the switching valve 72 is located at the first position (see FIGS. 9 and 10) where the free end 172 of the switching valve 72 contacts with the valve locking section 261 of the second finger inserting section 26 by the valve driving control section 514 controlling the valve driving motor 73. Thus, blowing from the heated air blowing unit 60 into the second finger inserting section 26 is blocked and blowing from the heated air blowing unit 60 is performed into the first finger inserting section 24 only.

In the parallel drying mode, the switching valve 72 is located at the second position (see FIGS. 13 and 14) where the free end 172 of the switching valve 72 is located between the valve locking section 261 of the second finger inserting section 26 and the upper surface of the first finger inserting section 24 by the valve driving control section 514 controlling the valve driving motor 73. Thus, blowing from the air blowing unit 60 is performed into both of the first finger inserting section 24 and the second finger inserting section 26.

In the real drying mode, the switching valve 72 is located at the third position (see FIGS. 11, 12, 15 and 16) where the free end 172 of the switching valve 72 contacts with the upper surface of the first finger inserting section 24 by the valve driving control section 514 controlling the valve driving motor 73. Thus, adjustment is made so that blowing from the heated air blowing unit 60 into the first finger inserting section 24 is blocked and blowing from the heated air blowing unit 60 is performed into the second finger inserting section 26 only.

The combination of control of the heater 62 and the blower 63 by the drying control section 513 and the control of the valve driving motor 73 by the valve driving control section 514 in each of the drying modes (that is, pre-drying mode, parallel drying mode and real drying mode) is not limited to the example illustrated here.

For example, in the parallel drying mode, the angle of the switching valve 72 can be adjusted in a plurality of levels by the control of the valve driving control section 514. That is, by adjusting the free end 172 of the switching valve 72 to be closer to the upper surface of the first finger inserting section 24, blowing into the first finger inserting section 24 can be suppressed to the level equivalent to the pre-drying and real drying can be performed on the nail part T in the second finger inserting section 26 to which more warm air is sent even when the temperature of the heater 62 is set to "HIGH" or blowing of the blower 63 is set to strong.

The drying control section 513 and the valve driving control section 514 appropriately determine which of the drying modes to correspond to when performing control, when to start and stop the drying and such like on the basis of printing conditions (that is, whether the printing finger U1 is under printing or printing is finished, and if under printing, which of the fingers is under printing, and such like) sent from the printing control section 512 and the image showing the location of the printing finger U1 obtained by the photographing section 30, for example.

Further, the control section 51 performs display control of the display section 13. In the embodiment, the control section 51 displays a list of design images, thumbnail images, various operation buttons and such like on the display section 13 and displays the images of the printing finger U1 and the nail part T obtained by the photographing section 30 on the display section 13 appropriately. For example, the control section 51 displays the image of the printing finger U1 inside the fir finger inserting section 24 obtained by the photographing section 30 on the display section 13 when a user sets the printing finger U1 in the first finger inserting section 24.

The control section 51 displays various types of instruction screens, notification screens, warning screens and such like on the display section 13. That is, for example, when the printing finger U1 is not located at the appropriate position (that is, the entire nail part T of the printing finger U1 is not exposed at the window section 241), the control section 51 displays the situation on the display section 13 to notify and encourage the user to insert the printing finger U1 up to the appropriate position. Further, when the printing finger U1 is located in the appropriate position, the control section 51 displays this situation on the display section 13. When the drying operation is finished (that is, a predetermined drying time such as 5 to 10 seconds for the pre-drying mode and the parallel drying mode and 20 to 30 seconds for the real drying mode elapses), this is displayed on the display section 13. At that time, the control section 51 may display an instruction screen to instruct removal of the printing finger U1, an instruction screen to instruct insertion of the next printing finger U1 (for example, index finger when the printing of the thumb is finished) into the first finger inserting section 24, an instruction screen to instruct insertion of the non-printing finger U2 into the second finger inserting section 26 on the display section 13.

Insertion state of the printing finger U1 (whether the printing finger U1 is inserted, whether the insertion location is appropriate and such like), end of the drying operation, end of the printing operation and such like may be notified by sound such as voice and alarm or by light such as lighting and blinking instead of or in addition to display on the display section 13, for example.

In the embodiment, the control section 51 determines the position of the nail part T of the printing finger U1 and detects the position, shape, range and such like of the nail part T which is a printing target on the basis of the image obtained by the photographing section 30, for example.

Further, the control section 51 determines insertion state (whether the finger is inserted or not) of the printing finger U1 on the basis of the image obtained by the photographing section 30. For example, when it is determined that the printing finger U1 is removed from the first finger inserting section 24 during printing, the control section 51 cancels or stops the printing operation of the printing section 40 by the control of the printing control section 512. When it is determined that the printing finger U1 is removed from the first finger inserting section 24 during drying, the control section 51 cancels or stops the drying operation of the heater 62 and the blower 63 by the control of the drying control section 513.

Next, action of the nail print apparatus 1 in the embodiment will be explained.

When performing printing by the nail print apparatus 1, a user operates the operation button 121 to turn on the power and activates the control device 50.

When the control device 50 is activated, the control section 51 displays design images which can be printed by the nail print apparatus 1 and the operation buttons to select the image on the display section 13. A design image to be printed is selected and set by the user selecting the desired design image and inputting the design image by touching the operation buttons on the touch panel. At this time, when the user wants to perform printing on nail parts T of a plurality of fingers (for example, nail parts T of the five fingers of the right hand), the user can also input the fingers to be printed (the kind and number of the fingers) on the touch panel. When the user wants to print different design images on respective fingers, the user inputs and sets a design image for each of the fingers. The embodiment takes a case where the same star design image D (see FIG. 18) is to be printed on the five fingers of the left hand as an example to be described.

When selection of design images and such like is completed, the user inserts the first finger (the thumb of the left hand in the embodiment) among the fingers which is set to be printed into the first finger inserting section 24 through the printing finger inlet port 23 as the printing finger U1 and inserts the other fingers (index finger, middle finger, ring finger and little finger) as non-printing fingers into the second finger inserting section 26 through the non-printing finger inlet port 25 (see FIG. 5).

The position and such like of the printing finger U1 inserted in the first finger inserting section 24 are photographed by the photographing section 30 as needed and the obtained image is displayed on the display section 13. The user inserts the printing finger U1 to the position appropriate for the printing while checking the position of the printing finger U1 on the display screen of the display section 13. When the printing finger U1 is inserted to the position where the entire nail part T of the printing finger U1 is exposed in the window section 241, completion of setting the printing finger U1 is notified to the user by display on the display screen of the display section 13 or sound, for example.

When setting of the printing finger U1 is completed, the control section 51 detects the position and shape of the nail part T from the image obtained by the photographing section 30 and prints the design image on the nail part T within the detected range by the printing section 40. Specifically, the print head 46 ejects ink onto the nail part T to print the design image D selected by the user on the nail part T while moving back and forth and left and right by the control of the printing control section 512.

When printing is completed for the printing finger U1 (the thumb of the left hand in the embodiment), a signal indicating the completion is sent to the drying control section 513 and the valve driving control section 514. The drying control section 513 and the valve driving control section 514 recognize that printing on the first printing finger U1 is finished (that is, the printed printing finger U1 exists in the first finger inserting section 24 and there is no printed finger in the second finger inserting section 26 yet) and adjust the heated air blowing unit 60 and the switching valve 72 so as to perform the pre-drying mode. Specifically, the drying control section 513 sets the heating temperature of the heater 62 to LOW and sets the blowing amount of the blower 63 to middle. The valve driving control section 514 controls the valve driving motor 73 to rotate the shaft 71 so as to locate the switching valve 72 at the first position (see FIGS. 9 and 10). In this state, drying operation is performed for 5 to 10 seconds and pre-drying of the nail part T of the thumb which is the printing finger U1 is completed. When the pre-drying is completed (that is, when the predetermined drying time of 5 to 10 seconds elapses), the completion of the pre-drying is notified to the user by a display on the display screen of the display section 13, a sound or such like. At this time, an instruction screen to instruct the user to remove the printed thumb from the first finger inserting section 24 and insert the next finger (the index finger of the left hand in the embodiment) into the first finger inserting section 24 may be displayed on the display section 13.

When the user removes the first printing finger U1 (thumb of the left hand in the embodiment) from the first finger inserting section 24 and inserts the next printing finger U1 (the index finger of the left hand in the embodiment) into the first finger inserting section 24, the position of the printing finger U1 inserted in the first finger inserting section 24 is photographed by the photographing section 30 and the obtained image is displayed on the display section 13 similarly as in the above case. The user inserts the printing finger U1 to the appropriate position while checking the screen and inserts the other fingers (the thumb which is already printed and middle finger, ring finger and little finger waiting for printing) in the second finger inserting section 26. When insertion of the second printing finger U1 is completed, the completion is notified and printing by the printing section 40 is started.

When printing is started for the second printing finger U1 (the index finger of the left hand in the embodiment), a signal indicating the start is sent to the drying control section 513 and the valve driving control section 514. The drying control section 513 and the valve driving control section 514 recognize that printing on the second printing finger U2 is started (that is, the printing finger U1 under printing exists in the first finger inserting section 24 and non-printing fingers U2 including the printed printing finger U1 exist in the second finger inserting section 26) and adjust the heated air blowing unit 60 and the switching valve 72 so as to perform the real drying mode. Specifically, the drying control section 513 set the heating temperature of the heater 62 to HIGH and sets the blowing from the blower 63 to strong (blowing amount is large). The valve driving control section 514 controls the valve driving motor 73 to rotate the shaft 71 so that the switching valve 72 is disposed at the third position (see FIGS. 11 and 12). In this state, drying is performed for 20 to 30 seconds and the real drying of the nail part T of the thumb which is the printing finger U1 inserted in the second finger inserting section 26 is completed. At that time, warm air is also blown to the nail parts T of the non-printing fingers U2 (that is, middle finger, ring finger and little finger) which are waiting for printing and thus the nail parts T are warmed to be softened and dried to be easy to put on the ink. When the real drying is completed (that is, when the predetermined drying time of 20 to 30 seconds elapses), the completion of the real drying of the non-printing fingers U2 including the thumb may be notified to the user by display on the display screen of the display section 13 or by the sound.

When the printing on the second printing finger U1 (the index finger of the left hand in the embodiment) is completed, a signal indicating the completion is sent to the drying control section 513 and the valve driving control section 514. The drying control section 513 and the valve driving control section 514 recognize that the printing on the second printing finger U1 is finished (that is, the printed printing finger U1 exists in the first finger inserting section 24 and another printed finger exists in the second finger inserting section 26) and adjust the heated air blowing unit 60 and the switching valve 72 so as to perform the parallel drying mode. Specifically, the drying control section 513 sets the heating temperature of the heater 62 to HIGH and sets the blowing from the blower 63 to weak (blowing amount is small). The valve driving control section 514 controls the valve driving motor 73 to rotate the shaft 71 so that the switching valve 72 is disposed at the second position (see FIGS. 13 and 14). In this state, drying is performed for 5 to 10 seconds and the pre-drying on the nail part T of the index finger which is the printing finger U1 in the first finger inserting section 24 and the real drying on the nail parts T of the non-printing fingers U2 including the printed thumb in the second finger inserting section 26 are completed. When the drying is completed (that is, when the predetermined drying time of 5 to 10 seconds elapses), the completion of the drying is notified to the user by display on the display screen of the display section 13 or the sound. At that time, an instruction screen instructing the user to remove the printed index finger from the first finger inserting section 24 and insert the next finger (the middle finger of the left hand in the embodiment) in the first finger inserting section 24 may be displayed on the display section 13.

When the user removes the second printing finger U1 (the index finger of the left hand in the embodiment) from the first finger inserting section 24 and inserts the next finger (the middle finger of the left hand in the embodiment) in the first finger inserting section 24, similarly as in the above case, the position and such like of the printing finger U1 inserted in the first finger inserting section 24 are photographed by the photographing section 30 and the obtained image is displayed on the display section 13. The user inserts the printing finger U1 to the appropriate position while checking the screen and inserts the other fingers (the thumb and index finger which are already printed and the ring finger and little finger waiting for printing) in the second finger inserting section 26. When the insertion of the third printing finger U1 is completed, the completion is notified and the printing by the printing section 40 starts.

Since the printing operation and the drying operation of the third to fifth fingers are similar to the operations described for the second printing finger U1, the explanation of the operations is omitted.

When printing operation is finished for all the printing fingers U1 (the five fingers of the left hand in the embodiment) which were set before starting the printing, the instruction screen instructing the user to insert all the fingers in the second finger inserting section 26 is displayed on the display screen of the display section 13.

When a predetermined time has passed after the above instruction screen is displayed or when the user inputs that all the fingers are inserted in the second finger inserting section 26 from the touch panel of the display section 13, the drying control section 513 and the valve driving control section 514 recognize that all the printed fingers exist in the second finger inserting section 26 and adjust the heated air blowing unit 60 and the switching valve 72 so as to perform the real drying mode. Specifically, the drying control section 513 sets the heating temperature of the heater 62 to HIGH and sets the blowing from the blower 63 to strong (blowing amount is large). The valve driving control section 514 controls the valve driving motor 73 to rotate the shaft 71 so that the switching valve 72 is disposed at the third position (see FIGS. 15 and 16). In this state, drying is performed for 20 to 30 seconds and the real drying of the nail parts T of all the printed fingers (the five fingers of the left hand in the embodiment) is completed.

Figure 18:
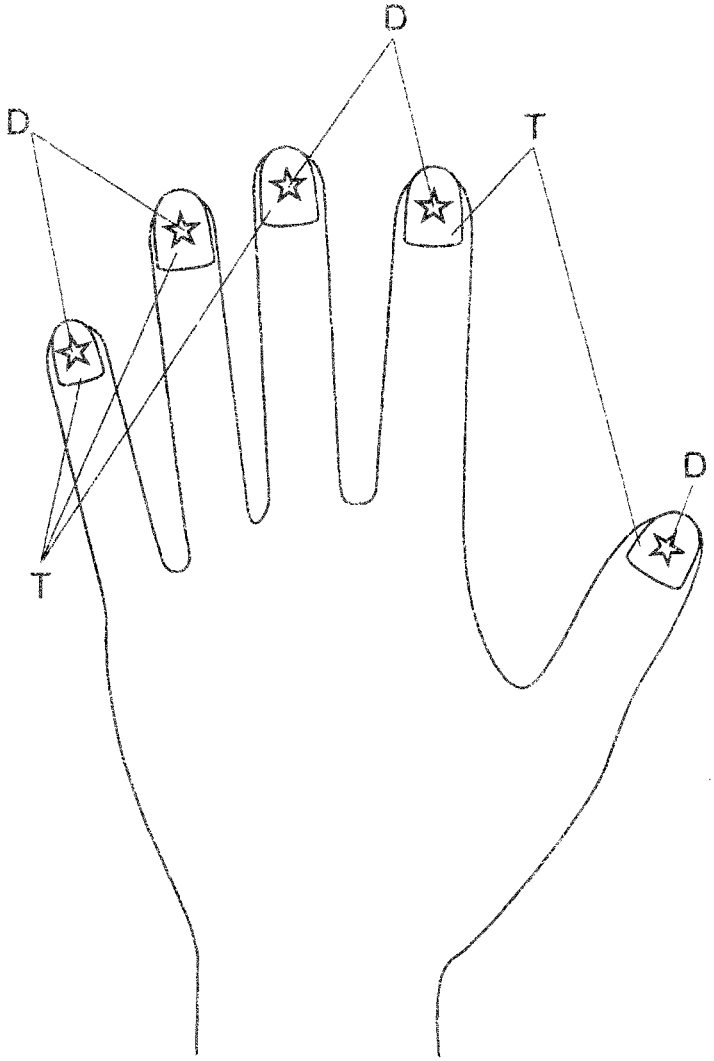
FIG. 18 is a plan view showing a state where a design image is printed on nail parts of the five fingers of a left hand.

Thus, as shown FIG. 18, the star design image is printed on the nail parts T of all the five fingers of the left hand and real drying (complete drying) of the printing on all the nail parts T is completed.

As described above, according to the nail print apparatus 1 in the embodiment, when the first finger inserting section 24 to insert the printing finger U1 corresponding to the nail part T which is a printing target is provided on one side of the dividing wall 20, the second finger inserting section 26 to insert the non-printing fingers U2 corresponding to the nail parts T which are not printing targets provided other side of the dividing wall 20 and printing is performed on the nail part T of the printing finger U1 inserted in the first finger inserting section 24 by the printing section 40, blowing in the first finger inserting section 24 and blowing in the second finger inserting section 26 by the heated air blowing unit 60 can be adjusted by the switching valve 72 as a blowing adjustment section. When drying operation such as heating by the heater 62 or blowing by the blower 63 is performed near a finger which is being printed by the print head 46, the ink ejecting section of the print head 46 becomes dry and difficult to eject the ink, disturbing the printing operation. On the other hand, if the drying operation is started after printing is completed for the nail parts T of all the fingers, it takes time to dry the ink of the printed parts completely, the fingers cannot move freely meanwhile and the user feels inconvenience. With respect to this, in a configuration of the embodiment, drying operation can be performed simultaneously without disturbing printing operation, and drying on the printed parts can be performed for a shorter time.

Especially, the embodiment includes the parallel drying mode and thus the switching valve 72 which is the blowing adjustment section can be adjusted so that blowing from the heated air blowing unit 60 is performed in both of the first finger inserting section 24 and the second finger inserting section 26. Thus, ink is dried by blowing warm air into the printed printing finger U1 in the first finger inserting section 24 and in parallel, the warm air can also be blown to the printed finger in the second finger inserting section 26, shortening the time required for drying the printed nail parts T completely. In this case, since the drying level in the first finger inserting section 24 is the same as the drying state in a case of the pre-drying by reducing the blowing amount by the blower, the influence on the print head 46 is suppressed as in the pre-drying and the printing operation is not disturbed.

In a case of the pre-drying mode, since the beating temperature of the heater 62 is set to be low and the blowing by the blower 63 is weak (blowing amount is small), influence on the print head 46 is reduced and the pre-drying can be performed suppressing the nozzle clogging and such like due to the drying of the print head 46.

In addition, since the pre-drying can be performed before removing the printed finger from the first finger inserting section 24, it is possible to prevent the image printed on the nail part T from contacting with the inside of the apparatus (the first finger inserting section upper surface 240, for example) and such like to blur and become ruined.

Also, during printing of a printing finger U1, only the non-printing fingers U2 inserted in the second finger inserting section 26 can be dried by the real drying mode. Thus, real drying (complete drying) of the printed nail part T can be performed effectively without influencing the printing operation.

When printing is finished for all the fingers, the nail parts T of all the fingers inserted in the second finger inserting section 26 can be dried by the real drying mode. Thus, the nail parts T of the printed fingers can be dried effectively and promptly.

Further, in the embodiment, drying is performed on the nail parts T of the fingers inserted in the second finger inserting section 26 which are not the printing finger U1 while or after printing a printing finger U1 as well as after all the fingers are printed. Thus, ink can be dried more surely by the repeated drying operation.

Further, in the embodiment, since drying operation is performed not only on the nail part T of the printed finger but also on the nail parts T of the fingers waiting for printing, the nail parts T can be warmed to be softened and dried while waiting for the printing. Thus, ink can be applied on the nail part T in a better condition.

Though the switching valve 72 is located at the first position blocking the blowing in the second finger inserting section 26 in the pre-drying mode in the embodiment, blowing control at the pre-drying mode is not limited to this. For example, the switching valve 72 may be located at the second position at the pre-drying mode to perform blowing in both of the first finger inserting section 24 and the second finger inserting section 26.

Second Embodiment

Next, the second embodiment of the nail print apparatus according to the present invention will be explained. This embodiment is different from the first embodiment in only the control structure of the heated air blowing unit and the switching valve, and the apparatus configuration of the nail print apparatus is same as the configuration shown in the first embodiment. Thus, hereinafter, the explanation of the apparatus configuration is omitted and the differences from the first embodiment will be explained.

In the embodiment, the nail print apparatus includes only the pre-drying mode and the real drying mode shown in the first embodiment.

The drying control section 513 controls the heater 62 and the blower 63 so as to perform the pre-drying mode every time the printing on the nail part T of the printing finger U1 is completed. When printing is completed for all the printing fingers U1 (five fingers of the left hand, for example) which are to be printed, the drying control section 513 controls the heater 62 and the blower 63 so as to perform the real drying mode.

In the pre-drying mode, the valve driving control section 514 which controls the switching valve 72 controls the valve driving motor 73 so that the switching valve 72 is located at the first position shown in the first embodiment. In the real drying mode, the valve driving control section 514 controls the Valve driving motor 73 so that the switching valve 72 is located at the third position shown in the first embodiment.

Other configurations are similar to those explained in the first embodiment, thus the explanation thereof is omitted.

Next, action of the nail print apparatus in the embodiment will be explained.

As in the first embodiment, printing by the printing section 40 is performed when the first printing finger U1 (the thumb of the left hand, for example) is located at the predetermined position in the first finger inserting section 24. When printing is completed for the first printing finger U1 (the thumb of the left hand, for example), a signal indicating the completion is sent to the drying control section 513 and the valve driving control section 514, and the drying control section 513 and the valve driving control section 514 control the heated air blowing unit 60 and the switching valve 72 so as to perform pre-drying on the nail part T of the printed printing finger U1 in the first finger inserting section 24. That is, by the control of the drying control section 513, the heating temperature of the heater 62 is set to LOW and blowing of the blower 63 is set to weak (blowing amount is small), and the switching valve 72 is located at the first position by the control of the valve driving control section 514. In this state, drying operation is performed for 5 to 10 seconds. Thus, pre-drying is completed for the nail part T of the first printing finger U1.

After pre-drying is completed, when the first printing finger U1 is removed from the first finger inserting section 24 and moved into the second finger inserting section 26 and the second printing finger U1 (the index finger of the left hand, for example) is located at the predetermined position in the first finger inserting section 24, printing is performed on the nail part T of the index finger by the printing section 40.

When printing is completed for the second printing finger U1, a signal indicating the completion is sent to the drying control section 513 and the valve driving control section 514, and the drying control section 513 and the valve driving control section 514 control the heated air blowing unit 60 and the switching valve 72 so as to perform pre-drying on the nail part T of the printed second printing finger U1 (the index finger of the left hand, for example) in the first finger inserting section 24, as in the case of the first printing finger U1 (the thumb of the left hand, for example).

The above operation is repeated for the third to fifth printing fingers U1 (middle finger, ring finger and little finger of the left hand) similarly, and when the printing and the pre-drying on the nail parts T are completed for all the printing fingers U1, the instruction screen to instruct the user to insert all the five fingers in the second finger inserting sect 26 is displayed on the display sections 13. Then, after a predetermined time elapses after the instruction screen is displayed, or when the user inputs that all the fingers are inserted in the second finger inserting section 26 through the touch panel on the display section 13, the drying control section 513 and the valve driving control section 514 recognize that all the printed fingers exist in the second finger inserting section 26 and control the heated air blowing unit 60 and the switching valve 72 to perform the real drying. That is, the heating temperature of the heater 62 is set to HIGH and blowing of the blower 63 is set to strong (blowing amount is large) by the control of the drying control section 513, and the switching valve 72 is located at the third position by the control of the valve driving control section 514. In this state, drying operation is performed for 20 to 30 seconds. Thus, the real drying is completed for the nail parts T of all of the printed fingers (the five fingers of the left hand in the embodiment).

As described above, according to the nail print apparatus the embodiment, the following effect can be obtained in addition to the same effect as in the first embodiment.

That is, the embodiment includes only the pre-drying mode and the real drying mode as the drying mode, simplifying the control by the drying control section 513 and the valve driving control section 514 to allow the effective pre-drying and real drying of the nail part T.

Further, too much drying of the nail part T can be avoided since the real drying is not repeatedly performed on the fingers waiting for printing and such like, and power consumption can be suppressed by suppressing the drying operation.

Though the embodiment takes a case where the nail print apparatus includes only the pre-drying mode and the real drying mode as a drying mode as an example, the embodiment may include the pre-drying mode, the parallel mode and the real drying mode as the drying mode as in the first embodiment and perform only the pre-drying mode or the real drying mode as shown in the second embodiment depending on user's selection, for example.

Third Embodiment

Next, the third embodiment of the nail print apparatus according to the embodiment will be explained with reference to FIG. 19. Hereinafter, the differences from the first embodiment will be particularly explained because the embodiment is different from the first embodiment only in the configurations of the heated air blowing unit 60 and the blowing adjustment section.

Figure 19:
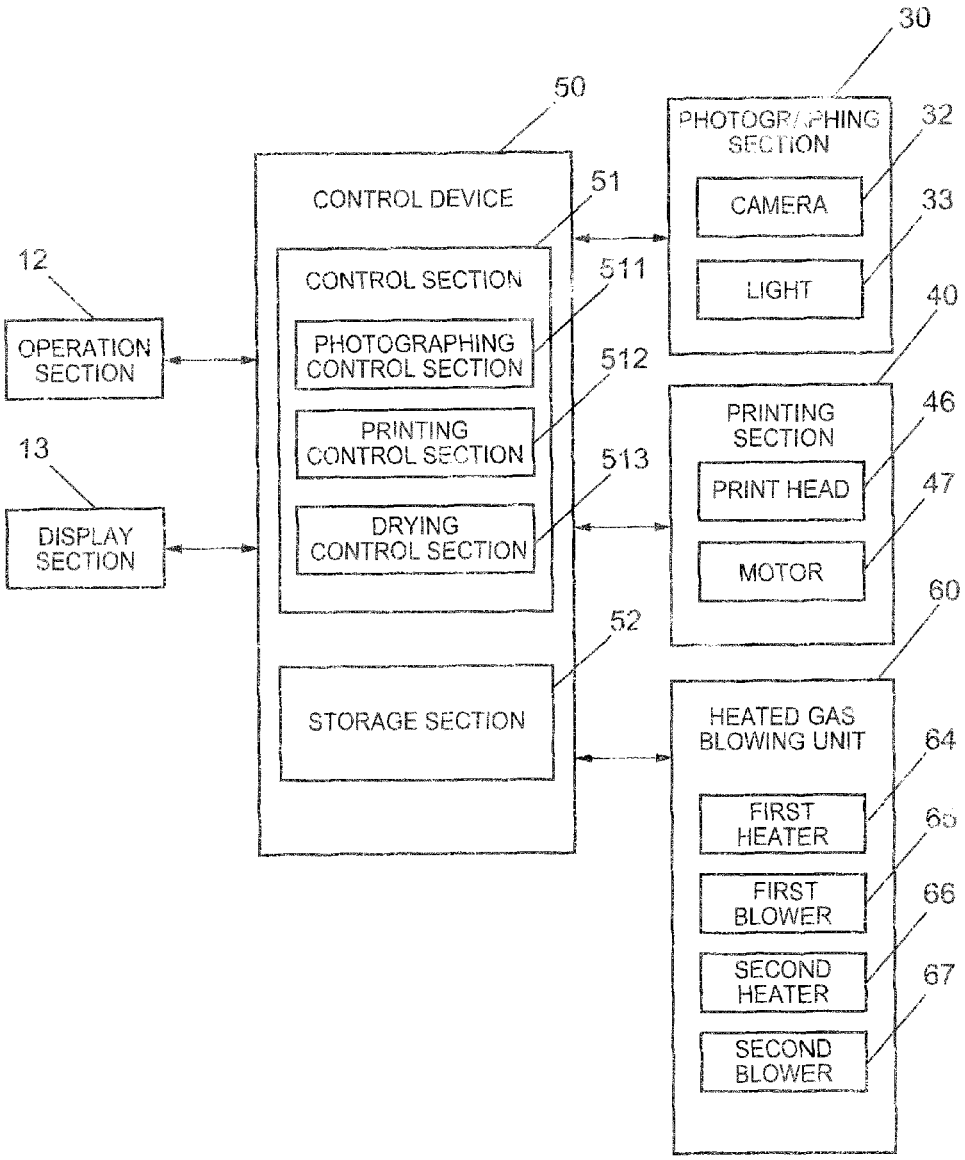
FIG. 19 is a main part block diagram of a nail print apparatus of a third embodiment.

As shown in FIG. 19, the nail print apparatus in the embodiment includes a first heater 64, a first blower 65, a second heater 66 and a second blower 67 as a heated air blowing unit 60. On the back surface of an apparatus main body 2, two air intake ports (not shown in the drawings) are formed corresponding to the first blower 65 and the second blower 67.

In the embodiment, there is no cut-away portion or such like in the dividing wall 20 which divides between the upper containing section 201 and the lower containing section 202, and the upper containing section 201 and the lower containing section 202 are divided without communicating with each other through the dividing wall 20.

A duct which is not shown in the drawings is connected to the back side, in the finger inserting direction, of the first finger inserting section 24 which is disposed in the upper containing section 201, and the first heater 64 and the first blower 65 are disposed in the duct.

The air heated by the first heater 64 is blown into the first finger inserting section 24 by the first blower 65

The second heater 66 and the second blower 67 are disposed in the lower containing section 202.

The air heated by the second heater 66 is blown into the second finger inserting section 26 provided in the lower containing section 202 by the second blower 67.

In the embodiment, the drying control section 513 controls the operations of the first heater 64, the first blower 65, the second heater 66 and the second blower 67 and functions as a blowing adjustment section which adjusts blowing in the first finger inserting section 24 and in the second finger inserting section 26 by the heated air blowing unit 60.

Specifically, when the drying is performed in the pre-drying mode, the drying control section 513 stops the second heater 66 and the second blower 67, sets the first heater 64 to LOW, sets the blowing of the first blower 65 to weak (blowing amount is small) and performs blowing to the nail part T of the printed printing finger U1 inserted in the first finger inserting section 24 for an approximately 5 to 10 seconds to pre-dry the nail part T.

When drying is performed in the parallel drying mode, the drying control section 513 sets the first heater 64 to LOW, sets the blowing of the first blower 65 to weak (blowing amount is small) and performs blowing to the nail part T of the printed printing finger U1 inserted in the first finger inserting section 24 for an approximately 5 to 10 seconds to pre-dry the nail part T, and at the same time, the drying control section 513 sets the second heater 66 to HIGH, sets the blowing of the second blower 67 to strong (blowing amount is large) and performs blowing to the nail parts T of the printed printing finger 131 and the other fingers which are waiting for printing inserted in the second finger inserting section 26 for an approximately 20 to 30 seconds to real dry the nail parts T.

When drying is performed in the real drying mode, the drying control section 513 stops the first heater 64 and the first blower 65, sets the second heater 66 to HIGH, sets the blowing of the second blower 67 to strong (blowing amount is large) and performs blowing to the nail part T of the printed printing finger U1 for an approximately 20 to 30 seconds to real dry the nail part T.

The other configurations are the same as the configurations explained in the first embodiment, and therefore the same members are designated by the same reference numerals and the explanation thereof is omitted.

Next, action, of the nail print apparatus in the embodiment will be explained.

As in the first embodiment, printing by the printing section 40 is performed when the first printing finger U1 (the thumb of the left hand, for example) is placed in the predetermined position in the first finger inserting section 24. When printing on the first printing finger U1 is completed, a signal indicating the completion is sent to the drying control section 513, and the drying control section 513 controls the heated air blowing unit 60 so as to perform the pre-drying on the printed printing finger U1 placed in the first finger inserting section 24. That is, by the control of the drying control section 513, the second heater 66 and the second blower 67 are stopped, the first heater 64 is set to LOW, the blowing of the first blower 65 is set to weak (blowing amount is small) and blowing is performed into the nail part T of the printed first printing finger U1 inserted in the first finger inserting section 24 to pre-dry the nail part T.

When the pre-drying is completed, the first printing finger U1 is removed from the first finger inserting section 24 to move into the second finger inserting section 26 and the second printing finger U1 (the index finger of the left hand, for example) is placed at the predetermined position in the first finger inserting section 24, printing is performed on the nail part T of the index finger by the printing section 40.

When printing is started for the second printing finger U1 (index finger), a signal indicating the start is sent to the drying control section 513. The drying control section 513 recognizes that the printing on the second printing finger U1 is started (that is, the printing finger U1 under printing exists in the first finger inserting section 24 and the non-printing fingers U2 including the printed printing finger U1 exist in the second finger inserting section 26) and adjusts the heated air blowing unit 60 to perform the real drying mode. That is, the drying control section 513 stops the first heater 64 and the first blower 65, sets the second heater 66 to HIGH, sets the blowing of the second blower 67 to strong (blowing amount is large) and performs blowing to the nail parts T of the printed printing finger U1 (the thumb of the left hand) inserted in the second finger inserting section 26 and the other fingers waiting for printing to real dry the nail part T.

When printing is completed on the second printing finger U1, a signal indicating the completion is sent to the drying control section 513 and the drying control section 513 recognizes that the printing on the second printing finger U1 is finished (that is, the printed printing finger U1 exists in the first finger inserting section 24 and other printed fingers exist in the second finger inserting section 26) and adjusts the heated air blowing unit 60 so as to perform the parallel drying mode. That is, the drying control section 513 sets the first heater 64 to LOW, sets the blowing of the first blower 65 to weak (blowing amount is small) and performs blowing to the nail part T of the printed printing finger U1 inserted in the first finger inserting section 24 to pre-dry the nail part T, and at the same time, the drying control section 513 the second heater 66 to HIGH, sets the blowing of the second blower 67 to strong (blowing amount is large) and performs blowing to the nail parts T of the printed printing finger U1 and the other fingers which are waiting for printing inserted in the second finger inserting section 26 to real dry the nail parts T.

The printing operation and the drying operation on the third to fifth fingers are same as those explained for the second printing finger U1 and thus the explanation thereof is omitted.

When the printing operation is finished for all the printing fingers U1 (the five fingers of the left hand in the embodiment) which were set before the start of printing, an instruction screen to instruct a user to insert all the fingers in the second finger inserting section 26 is displayed on the display screen of the display section 13.

When a predetermined time elapses after the instruction screen was displayed, or when a user inputs that all the fingers are inserted in the second finger inserting section 26 through the touch panel of the display section 13, the drying control section 513 recognizes that all the printed fingers exist in the second finger inserting section 26 and adjusts the heated air blowing unit 60 so as to perform the real drying mode. That is, the drying control section 513 stops the first heater 64 and the first blower 65, sets the second heater 66 to HIGH, sets the blowing of the second blower 67 to strong (blowing amount is large) and performs blowing to the nail parts T of all the printed fingers inserted in the second finger inserting section 26. Thus, the real drying is completed for the nail parts T of all the fingers.

As described above, according to the nail print apparatus of the embodiment, the following effect can be obtained in addition to the same effect as in the first embodiment.

That is, in the embodiment, the apparatus configuration can be simplified since it is not necessary to provide a switching valve and a mechanism to drive the valve as a blowing adjustment section.

In a case where the heated air blowing unit 60 includes the first heater 64, the first blower 65, the second heater 66 and the second blower 67 as in the embodiment as well, only the pre-drying mode and the real drying mode may be performed as shown in the second embodiment, for example.

Also, there may be such configuration that the selectable drying mode includes three of the pre-drying mode, the parallel drying mode and the real drying mode and only the pre-drying mode or the real drying mode is performed depending on the selection by the user or the like, for example.

Also, in such configuration that blowing equivalent to the pre-drying is performed into the first finger inserting section 24 and blowing equivalent to the real drying is performed into the second finger inserting section 26 in both of the pre-drying mode and the parallel drying mode, the drying control section 513 may merely control ON/OFF of the first heater 64, the first blower 65, the second heater 66 and the second blower 67 by allowing only the setting of the first heater 64 to be LOW, the first blower 65 to be weak (blowing amount is small), the second heater 66 to be HIGH and the second blower 67 to be strong (air volume is large).

In such case, the control structure of the drying control section 513 is simplified and the heated air blowing unit 60 can be inexpensive since the heater and the blower thereof do not need adjustment.

Though the embodiments of the present invention have been described, the present invention is not limited to the above embodiments and it goes without saying that various changes can be made within the scope of the present invention.

For example, in each of the above embodiments, the inside of the first finger inserting section 24 is photographed by the photographing section 30 and on the basis of the obtained image, the presence or absence of the printing finger U1 inserted in the first finger inserting section 24, location of the printing finger U1 inserted in the first finger inserting section 24 and such like are detected. However, the structure of detecting the insertion state, location and such like of the printing finger U1 is not limited to this. For example, the insertion state, location and such like of the printing finger U1 may be detected by a sensor or such like which are provided in the first finger inserting section 24 and detects the insertion of the printing finger U1.

Also, the above embodiments take a case where the drying control section 513 and the valve driving control section 514 appropriately determine which of the drying mode to correspond to for performing control on the basis of printing conditions and such like sent from the printing control section 512 and such like, as an example to be described. However, a method of switching the drying modes is not limited to this. For example, a user may select a desired drying mode by operating the operation button, and the drying control section 513 and the valve driving control section 514 may perform control corresponding to the selected drying mode.

Further, though the above embodiments take a case where heating temperature and heating time of a heater and blowing amount and blowing time of a blower can be controlled ac an example, all of them do not need to be controlled or adjusted.

Though the above embodiments take a case where a heater can be adjusted in two levels of HIGH and LOW and a blower can be adjusted in two levels of strong and weak as an example to be described, the heater and the blower may be controlled or adjusted in a wider range of a plurality of levels.

The heating temperature and heating time of the heater are not limited to the range shown in the above embodiments as long as they are in a range where the finger does not become hot or burnt and can be dried. The heating time may be adjusted by making the heater closer to or far away from the tip of the finger. When feeling hot at a finger, a user may stop the heater by hand by pressing a heating stop button or such like even during the heating. Alternatively, a temperature sensor may be provided in the printing finger inlet port 23 or in the second finger inserting section 26 so that the heating by the heater is stopped automatically and only the blower is operated when the temperature exceeds a predetermined value.

As a blower in the embodiments, among blowers with a compression ratio (a ratio of discharge pressure to suction pressure in a fluid machine) of less than two, a fan with a compression ratio of 1.1 or less may be used and a blower with a compression ratio of approximately 1.1 to 2 may be used instead of the fan. In addition, a air compressor with a compression ratio of two or more may be used.

Though in the first and second embodiments, the switching valve 72 is automatically operated by the valve driving control section 514 operating the valve driving motor 73, the structure of operating the switching valve 72 is not limited to this. For example, the switching valve 72 may be rotated to a desired position by rotating the shaft 71 which supports the switching valve 72 by hand.

Though the embodiments include the integrated print head 46 in which the ink cartridge is integrally provided, the configuration of the print head 46 is not limited to this. For example, the ink cartridge may be provided separately from the print head and connected to the print head 46 via the ink supply tube to supply ink to the print head 46 appropriately.

Though the embodiments take a nail print apparatus 1 in which a printing finger U1 is inserted in the first finger inserting section 24 one by one and printing is performed on the nail part T of the printing finger U1 as an example, the nail print apparatus is not limited to the apparatus performing printing on a finger one by one and printing may be performed in parallel on the nail parts T of a plurality of printing fingers U1 by inserting the plurality of printing fingers U1 in the first finger inserting section 24 at the same time. In such case, the first finger inserting section 24 is formed to be large enough to insert a plurality of printing fingers U1.

Though several embodiments of the present invention have been described, the scope of the present invention is not limited to the above-mentioned embodiments and includes the scope of the invention described in claims and the equivalent thereof.

According to one aspect of the preferred embodiments of the present invention, there is provided a nail print apparatus, including a dividing wall, a first finger inserting section which is provided in one space divided by the dividing wall and in which a finger is inserted, a print head which is provided in the one space divided by the dividing wall and performs printing on a nail part of the finger inserted in the first finger inserting section, a second finger inserting section which is provided in other space divided by the dividing wall and in which a finger is inserted, and a blowing section which blows air into the first finger inserting section and into the second finger inserting section.

Preferably, the nail print apparatus further includes a blowing adjustment section which adjusts blowing into the first finger inserting section and blowing into the second finger inserting section, and the finger which is inserted in the first finger inserting section is a finger corresponding to a nail part which is a printing target, the finger which is inserted in the second finger inserting section is a finger corresponding to a nail part which is not the printing target, the blowing section is included in a heated air blowing unit, the heated air blowing unit includes a heater and the blowing section blows air heated by the heater into the first finger inserting section and into the second finger inserting section, and the blowing adjustment section adjusts blowing so that the heated air is to be blown into both the first finger inserting section and the second finger inserting section.

Preferably, the blowing adjustment section is a switching valve, heating temperature of the heater can be adjusted in a plurality of levels and blowing amount of the blowing section can be adjusted in a plurality of levels.

Preferably, the nail print apparatus further includes a drying control section which controls the heating temperature and heating time of the heater and the blowing amount and blowing time of the blowing section.

Preferably, a cut-away section is formed at the back side, in a finger inserting direction, of the dividing wall in the first finger inserting section, a shaft is provided so as to be rotatable at an end portion of the cut-away section of the dividing wall, the switching valve is attached to the shaft and a valve driving motor which is a driving source is connected to the shaft, and the switching valve is rotatable, upward and downward, around an axis of the shaft by a driving force from the valve driving motor transmitted to the switching valve through the shaft.

Preferably, a valve locking section which locks the switching valve is provided at a position in a back side, in the finger inserting direction, of the second finger inserting section that corresponds to the cut-away section of the dividing wall.

Preferably, the nail print apparatus further includes an air intake port which is provided at a position corresponding to the blowing section of the heated air blowing unit; and a duct which is provided in the back side, in a finger inserting direction, of the first finger inserting section and the second finger inserting section, the duct communicating with the air intake port, the first finger inserting section and the second finger inserting section.

Preferably, The nail print apparatus further includes a valve driving control section, and the switching valve stops at a plurality of positions to make the blowing amount in the first finger inserting section and the blowing amount in the second finger inserting section by the heated air blowing unit different by control of the valve driving control section.

Preferably, the blowing section is a fan.

Preferably, by the valve driving control section controlling the valve driving motor, the switching valve is located at a first position, where a free end of the switching valve contacts with a valve locking section of the second finger inserting section, a second position where the free end of the switching valve is located between the valve locking section of the second finger inserting section and an upper surface of the first finger inserting section, the switching valve not contacting either with the valve locking section of the second finger inserting section or with the upper surface of the first finger inserting section, and a third position where the free end of the switching valve contacts with the upper surface of the first finger inserting section.

Preferably, when the switching valve is located at the first position, adjustment is de so that blowing from the heated air blowing unit into the second finger inserting section is blocked and blowing is performed from the heated air blowing unit into the first finger inserting section only, when the switching valve is located at the second position, adjustment is made so that blowing is performed from the heated air blowing unit into both of the first finger inserting section and the second finger inserting section, and when the switching valve is located at the third position, adjustment is made so that blowing from the heated air blowing unit into the first finger inserting section is blocked and blowing from the heated air blowing unit is performed into the second finger inserting section only.

Preferably, a plurality of the heaters and a plurality of the blowing sections are provided, and the first finger inserting section and the second finger inserting section are divided by the dividing wall without communicating with each other.

The entire disclosure of Japanese Patent Application No. 2012-054669 filed on Mar. 12, 2012 including description, claims, drawings, and abstract are incorporated herein by reference in its entirety.

What is claimed is:

1. A nail print apparatus, comprising:

a dividing wall;

a first finger inserting section which is provided in one space divided by the dividing wall and in which a finger is inserted;

a print head which is provided in the one space divided by the dividing wall and performs printing on a nail part of the finger inserted in the first finger inserting section;

a second finger inserting section which is provided in other space divided by the dividing wall and in which a finger is inserted; and a blowing section which blows air into the first finger inserting section and into the second finger inserting section.

2. The nail print apparatus according to claim 1, further comprising:

a blowing adjustment section which adjusts blowing into the first finger inserting section and blowing into the second finger inserting section, wherein the finger which is inserted in the first finger inserting section is a finger corresponding to a nail part which is a printing target, the finger which is inserted in the second finger inserting section is a finger corresponding to a nail part which is not the printing target, the blowing section is included in a heated air blowing unit, the heated air blowing unit includes a heater and the blowing section blows air heated by the heater into the first finger inserting section and into the second finger inserting section, and the blowing adjustment section adjusts blowing so that the heated air is to be blown into both the first finger inserting section and the second finger inserting section.

3. The nail print apparatus according to claim 2, wherein the blowing adjustment section is a switching valve, heating temperature of the heater can be adjusted in a plurality of levels and blowing amount of the blowing section can be adjusted in a plurality of levels.

4. The nail print apparatus according to claim 3, further comprising:

a drying control section which controls the heating temperature and heating time of the heater and the blowing amount and blowing time of the blowing section.

5. The nail print apparatus according to claim 3, wherein a cut-away section is formed at the back side, in a finger inserting direction, of the dividing wall in the first finger inserting section, a shaft is provided so as to be rotatable at an end portion of the cut-away section of the dividing wall, the switching valve is attached to the shaft and a valve driving motor which is a driving source is connected to the shaft, and the switching valve is rotatable, upward and downward, around an axis of the shaft by a driving force from the valve driving motor transmitted to the switching valve through the shaft.

6. The nail print apparatus according to claim 5, wherein a valve locking section which locks the switching valve is provided at a position in a back side, in the finger inserting direction, of the second finger inserting section that corresponds to the cut-away section of the dividing wall.

7. The nail print apparatus according to claim 2, further comprising:

an air intake port which is provided at a position corresponding to the blowing section of the heated air blowing unit; and a duct which is provided in the back side, in a finger inserting direction, of the first finger inserting section and the second finger inserting section, the duct communicating with the air intake port, the first finger inserting section and the second finger inserting section.

8. The nail print apparatus according to claim 5, further comprising:

a valve driving control section, wherein the switching valve stops at a plurality of positions to make the blowing amount in the first finger inserting section and the blowing amount in the second finger inserting section by the heated air blowing unit different by control of the valve driving control section.

9. The nail print apparatus according to claim 1, wherein the blowing section is a fan.

10. The nail print apparatus according to claim 8, wherein by the valve driving control section controlling the valve driving motor, the switching valve is located at a first position where a free end of the switching valve contacts with a valve locking section of the second finger inserting section, a second position where the free end of the switching valve is located between the valve locking section of the second finger inserting section and an upper surface of the first finger inserting section, the switching valve not contacting either with the valve locking section of the second finger inserting section or with the upper surface of the first finger inserting section, and a third position where the free end of the switching valve contacts with the upper surface of the first finger inserting section.

11. The nail print apparatus according to claim 10, wherein when the switching valve is located at the first position, adjustment is made so that blowing from the heated air blowing unit into the second finger inserting section is blocked and blowing is performed from the heated air blowing unit into the first finger inserting section only, when the switching valve is located at the second position, adjustment is made so that blowing is performed from the heated air blowing unit into both of the first finger inserting section and the second finger inserting section, and when the switching valve is located at the third position, adjustment is made so that blowing from the heated air blowing unit into the first finger inserting section is blocked and blowing from the heated air blowing unit is performed into the second finger inserting section only.

12. The nail print apparatus according to claim 2, wherein a plurality of the heaters and a plurality of the blowing sections are provided, and the first finger inserting section and the second finger inserting section are divided by the dividing wall without communicating with each other.

* * * * *